US012078447B2

(12) United States Patent
Walthert

(10) Patent No.: US 12,078,447 B2
(45) **Date of Patent: *Sep. 3, 2024**

(54) CROSSBOW BOWSTRING POSITIONING SYSTEM

(71) Applicant: Ravin Crossbows, LLC, Superior, WI (US)

(72) Inventor: Hans J. Walthert, Rush, NY (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/532,594

(22) Filed: Nov. 22, 2021

(65) Prior Publication Data

US 2022/0155039 A1 May 19, 2022

Related U.S. Application Data

(63) Continuation of application No. 16/841,248, filed on Apr. 6, 2020, now Pat. No. 11,181,337, which is a (Continued)

(51) Int. Cl.

| | |
|---|---|
| ***F41B 5/18*** | (2006.01) |
| ***F41B 5/12*** | (2006.01) |
| ***F41B 5/14*** | (2006.01) |

(52) U.S. Cl.

CPC ..... *F41B 5/1469* (2013.01); *F41B 5/12* (2013.01); *F41B 5/123* (2013.01); *F41B 5/1411* (2013.01)

(58) Field of Classification Search

CPC ..... F41B 5/1469; F41B 5/12; F41B 5/123; F41B 5/1411

(Continued)

(56) References Cited

U.S. PATENT DOCUMENTS 1,125,107 A * 1/1915 Jacques ..... B66D 1/06 254/378
8,689,774 B1 * 4/2014 Ritz ..... F41B 5/1469 124/25

(Continued)

OTHER PUBLICATIONS

Non Final Office Action dtd Aug. 14, 2019 for U.S. Appl. No. 16/245,245 "Crossbow Bowstring Positioning System" Walthert, 5 pages.

(Continued)

*Primary Examiner* — John E Simms, Jr.
(74) *Attorney, Agent, or Firm* — Foley & Lardner LLP

(57) ABSTRACT

Crossbow bowstring positioning systems are provided. In one aspect of the invention a crossbow bowstring positioning system has a crank housing supporting an axle and positioning a first connector at a front facing surface of the crank housing, a length of rope connected between two separated points on the axle; a bowstring connector joined to the length of rope and connectable to a bowstring of the crossbow, a mounting having a buffer tube mount mountable to a buffer tube of a crossbow; and a crank operable to rotate the axle to control an extent to which the rope is wound onto the axle and a position of the bowstring connector relative to the axle. The crank housing and mounting can be readily assembled in a small space and an efficient manner while providing paths through which a force experienced by the axle during use can be resisted.

8 Claims, 33 Drawing Sheets

Related U.S. Application Data continuation of application No. 16/245,245, filed on Jan. 10, 2019, now Pat. No. 10,612,884.

(60) Provisional application No. 62/616,035, filed on Jan. 11, 2018.

(58) Field of Classification Search
USPC ..... 124/25
See application file for complete search history.

(56) References Cited

U.S. PATENT DOCUMENTS

| | | | | |
|---|---|---|---|---|
| 9,752,844 | B1 | 9/2017 | Huang | |
| 10,612,884 | B2 * | 4/2020 | Walthert | F41B 5/1411 |
| 10,690,436 | B1 * | 6/2020 | Kempf | F41B 5/1469 |
| 11,181,337 | B2 * | 11/2021 | Walthert | F41B 5/1469 |
| 2006/0169258 | A1 * | 8/2006 | Chang | F41B 5/123 124/25 |
| 2009/0277435 | A1 * | 11/2009 | Pestrue | F41B 5/12 124/1 |
| 2015/0345894 | A1 * | 12/2015 | Khoshnood | F41B 5/1469 124/88 |
| 2016/0258709 | A1 * | 9/2016 | McPherson | F41B 5/1469 |
| 2019/0033033 | A1 | 1/2019 | Vergara | |
| 2020/0300574 | A1 | 9/2020 | Walthert | |

OTHER PUBLICATIONS

Office Action for U.S. Appl. No. 16/841,248, mailed on Nov. 16, 2020, Walthert, "Crossbow Bowstring Positioning System", 6 Pages.

* cited by examiner

CROSSBOW BOWSTRING POSITIONING SYSTEM

This Application is a continuation of and claims priority to U.S. patent application Ser. No. 16/841,248, filed Apr. 6, 2020, now U.S. Pat. No. 11,181,337, issued Nov. 23, 2021, which is a continuation of and claims priority to U.S. patent application Ser. No. 16/245,245, filed Jan. 10, 2019, now U.S. Pat. No. 10,612,884, issued Apr. 7, 2020, which claims priority to U.S. Provisional Patent Application No. 62/616,035, filed Jan. 11, 2018, which are incorporated herein by reference.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

Field of the Invention

The present disclosure relates to crossbows and, more particularly, systems for positioning crossbow bowstrings during cocking and de-cocking operations.

Description of Related Art

FIG. 1 shows a right side view, FIG. 2 shows a left side view and FIG. 3 shows a top view of a crossbow 100 of the prior art. As is shown in FIGS. 1-3, crossbow 100 has a firing system 110 having a firing grip area 112, a trigger 114 and a string capture and fire control system 116 all joined by a frame 118. In crossbow 100, a buffer tube 130 extends rearward from frame 118 and a stock 120 is joined thereto. Stock 120 is shaped to allow a user to position a shoulder of a user against butt 122 of stock 120 during aiming and firing of crossbow 100. In embodiments, stock 120 is shaped to receive at least a portion of buffer tube 130 at any of a range of positions along the length of buffer tube 130. This allows a user to adjust the distance between a shoulder of the user and firing grip area 112 within a range of distances that will allow comfortable use by a variety of different sized users. In the embodiment illustrated, buffer tube 130 has a ridge area 132 that provides surfaces 134 and 136 that are at least in part not aligned with an axial plane of a cylindrical cross section of buffer tube 130 and against which stock 120 can be mounted to prevent axial rotation of stock 120 about buffer tube 130. In embodiments ridge area 132 may be notched with stock 120 providing a fastener or other engagement device to interact with the notches to hold stock 120 at a preferred distance from firing grip area 112.

Barrel 140 extends between frame 118 and a bow 150. Bow 150 has a riser a 160 that links barrel 140 to at least a first limb 170 and a second limb 172. Optionally crossbow 100 may have additional limbs such as a third limb 174 and fourth limb 176.

In the example of FIGS. 1, 2 and 3, first limb 170 and third limb 174 are joined at their respective first ends end to and extend from riser 160 on the right side of crossbow 100 in a generally parallel fashion toward their respective second ends. Similarly in the example of FIGS. 1, 2, and 3, second limb 172 and fourth limb 176 are joined at a first end to and extend from riser 160 on the left side of crossbow 100 in a generally parallel fashion toward respective second ends thereof.

As is shown in FIGS. 1 and 3, a right side cam 190 is positioned between first limb 170 and third limb 174 proximate the second ends of first limb 170 and third limb 174 by a pin 200 or other structure assembled or otherwise provided between first limb 170 and third limb 174 and about which right side cam 190 can pivot. As is shown in FIGS. 2 and 3, a left side cam 192 is positioned between second limb 172 and fourth limb 176 proximate the second ends of second limb 172 and fourth limb 176 by a pin 202 or other structure assembled or provided between second limb 172 and fourth limb 176 and about which left side cam 192 can pivot. Although illustrated as having a circular shape, in FIGS. 1-3, right side cam 190 and left side cam 192 may take the form of a shaped cam.

As is shown in FIGS. 1-3, a bowstring string 210 is provided having ends tied to cams 190 and 192.

Tension in bowstring 210 is typically established by action of limbs 170, 172, 174, and 176 during assembly of crossbow 100. This is generally accomplished by applying a compressive force against limbs 170 and 174 and limbs 172 and 176 sufficient to drive the second ends of limbs 170 and 174 and second ends of limbs 172 and 176 toward each other until they reach a first range of relative positions.

Limbs 170, 172, 174 and 176 are shaped and made of materials that are elastically deformable within a range of elastic deformation and the first range of relative positions is defined so that the limbs are within a first portion of the range of elastic deformation.

Bowstring 210 and lateral support strings 212, 214 and 216 are installed with limbs 170, 172, 174 and 176 in the first range of positions. In this embodiment, bowstring 210 and lateral support string 216 are connected to right side cam 190 and to left side cam 192 while lateral support strings 214 216 are connected to limbs 170, 172, 174, and 176. Such connections are done so that limbs 170, 172, 174, and 176 will be held within the first range of positions after the compressive force is removed. Thereafter limbs 170, 172, 174, and 176 resist being held in this state and apply a first range of bias forces against bowstring 210.

To ready crossbow 100 for use, bowstring 210 is pulled from an initial configuration shown in FIGS. 1-3 to a firing configuration shown in FIG. 4. As is shown in FIGS. 4, the drawing bowstring 210 from the initial position to the firing position causes further elastic deformation and bending of limbs 170, 172, 174 and 176 from the first range of elastic deformation to a second range of elastic deformation. Limbs 170, 172, 174, and 176 resist this greater amount of elastic deformation by applying even greater forces than are applied against bowstring 210 when bowstring 210 is in the initial configuration. Accordingly, kinetic energy exerted in moving bowstring 210 from the initial configuration to the firing configuration is stored as potential energy in limbs 170, 172, 174, and 176.

Once bowstring 210 is drawn to the firing configuration, fire control system 116 grips bowstring 210 and holds bowstring 210 in the firing configuration against the bias supplied by limbs 170, 172, 174 and 176. When bowstring 210 is securely engaged and controlled by fire control system 116, the user then loads an arrow 230 onto barrel 140 and positions arrow 230 such that when fire control system 116 releases bowstring 210, bowstring 210 will drive arrow 230 along barrel 140.

In operation, a user grasps crossbow 100 at firing grip area +, and by a foregrip 144, which in this embodiment has flanges 146 and 148. The user typically may, if desired, place butt 122 of stock 120 against his or her shoulder and aim using a sighting system 124 that is aligned generally with a longitudinal axis of barrel 140 often this aiming process brings a user's cheek in contact with an upper portion 126 of stock 120.

As is shown in FIGS. 4 and 5, drawing bowstring 210 from the initial position to the firing position requires further bending of limbs 170, 172, 174 and 176 from the first range of elastic deformation to a second range of elastic deformation. Limbs 170, 172, 174, and 176 resist this greater amount of deformation by applying even greater forces than are applied against bowstring 210 when bowstring 210 is in the first range of positions.

The amount of energy applied against arrow 230 by crossbow 100 is a function of the amount of energy that a user stores in limbs 170, 172, 174, and 176 when drawing string 100 from the first range of positions to the firing position. Accordingly, for crossbow 100 to supply sufficient kinetic energy to drive arrow 230 from crossbow 100 at greater velocities and to deliver higher levels of kinetic energy upon impacting a target it is necessary for limbs 100, 170, 172, 174, and 176 to store significant potential energy as bowstring 210 is drawn from the first range of positions to the firing position.

In general, these demands have the effect of increasing the burden placed on a user when drawing a bowstring from the first range of positions to the firing position and the need for mechanical assistance in cocking a crossbow has long been recognized. Various types of mechanical cranks, levers, and other aids have been associated with crossbows. One example of which is described in U.S. Pat. No. 6,874,491.

It will be appreciated that such systems can in some cases add weight, complexity, and bulk to a crossbow making such difficult to carry, aim accurately and maintain.

Alternatively, separable pulling systems are known that can be joined to the crossbow to provide mechanical advantage to the user in drawing the crossbow string and then at least in part removed once the crossbow bowstring is in the firing position. In one example U.S. Pat. No. 7,100,590 issued to Chang on Sep. 5, 2006. Chang describes a mounting base and a bowstring drawing reeling device. The mounting base mounts to a butt of a crossbow by way of screws. The mounting base provides a rail. Reeling device has a casing with a bottom face and a rail recess defined in the bottom face of casing to slidably engage with rail of mounting base. This system requires mounting the mounting base to the butt of the crossbow in a manner that permanently alters the stock—and that creates an extended distance between the point of cranking and a hook that will be joined to the bowstring. This can have the effect of increasing the risks of snagging during cranking and increasing the extent of any non-longitudinal loads placed on any mechanical structure between the bowstring and the crank particularly in circumstances where such loads are transmitted along paths that non-parallel to the direction that the bowstring will take during of cocking or firing.

In the '590 patent rail type design, a stop is required to react to forces applied at least in part along the length of rails. All forces acting on the rail system at least in part along other directions must be answered by the engagement between the rail and the rail mounting. However, such rails and rail mountings offer only a limited extent of engagement per unit length. Specifically, rail systems provide only an extent of the physical overlap of the rail and rail mounting along the edges of such rails to resist forces that are not applied parallel to the rail. This overlap is further reduced to the extent that such rail systems can have variations in dimensions attributable to manufacturing tolerances or in certain circumstances caused in the field by thermal expansion or contraction.

In crossbow bowstring positioning there is a potential that these other forces may be significant. In order to lower the amount of force that any unit of length of the rails must be capable of resisting, rail based systems tend to use elongate rails, with elongate mountings. However, assembly of elongate rail mountings to elongate rails requires that there be elongate approaches to the rails. Thus the use of such rail type systems is often limited to circumstances where there is a clear approach to the rail system, such as butt mounting as demonstrated in the '590 patent and such systems are not well suited to confined areas on weapon systems.

Existing separate and separable systems such as rope cockers and separate crossbow cocking mechanisms are also known but these can be challenging to carry to the field and/or difficult to attach and use with the crossbow.

Thus a need exists for an improved crossbow bowstring drawing system that can avoid these difficulties while being ready for low cost reliable manufacturing and still providing user friendly assembly to and removal from the crossbow, and that are capable of being installed in areas with limited space.

BRIEF SUMMARY OF THE INVENTION

Crossbow bowstring positioning systems are provided. In one aspect of the invention a crossbow bowstring positioning system has a crank housing supporting an axle and positioning a first connector at a front facing surface of the crank housing, a length of rope connected between two separated points on the axle; a bowstring connector joined to the length of rope and connectable to a bowstring of the crossbow, a mounting having a buffer tube mount mountable to a buffer tube of a crossbow; and a crank operable to rotate the axle to control an extent to which the rope is wound onto the axle and a position of the bowstring connector relative to the axle. The crank housing and mounting can be readily assembled in a small space and an efficient manner while providing paths through which a force experienced by the axle during use can be resisted.

BRIEF DESCRIPTION OF THE SEVERAL VIEWS OF THE DRAWING(S)

Figure 1:
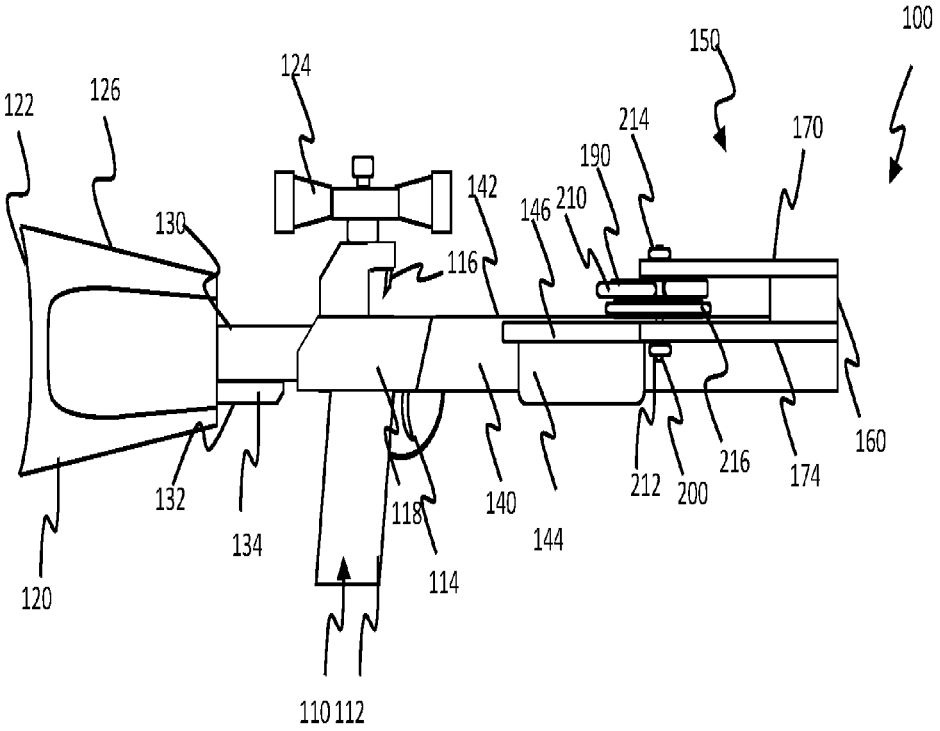
FIG. 1 (Prior Art)
FIG. 1 shows a right side view of a crossbow of a type known in the art.
Figure 2:
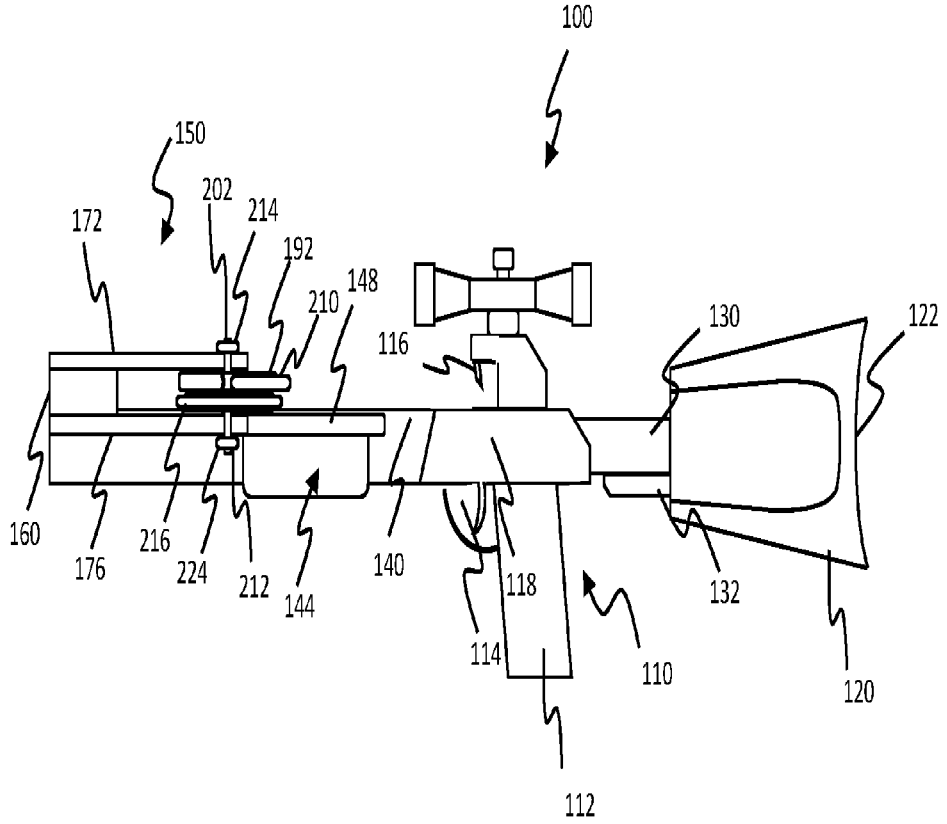
FIG. 2 (Prior Art)
FIG. 2 shows a right side view of the crossbow of FIG. 1.
Figure 3:
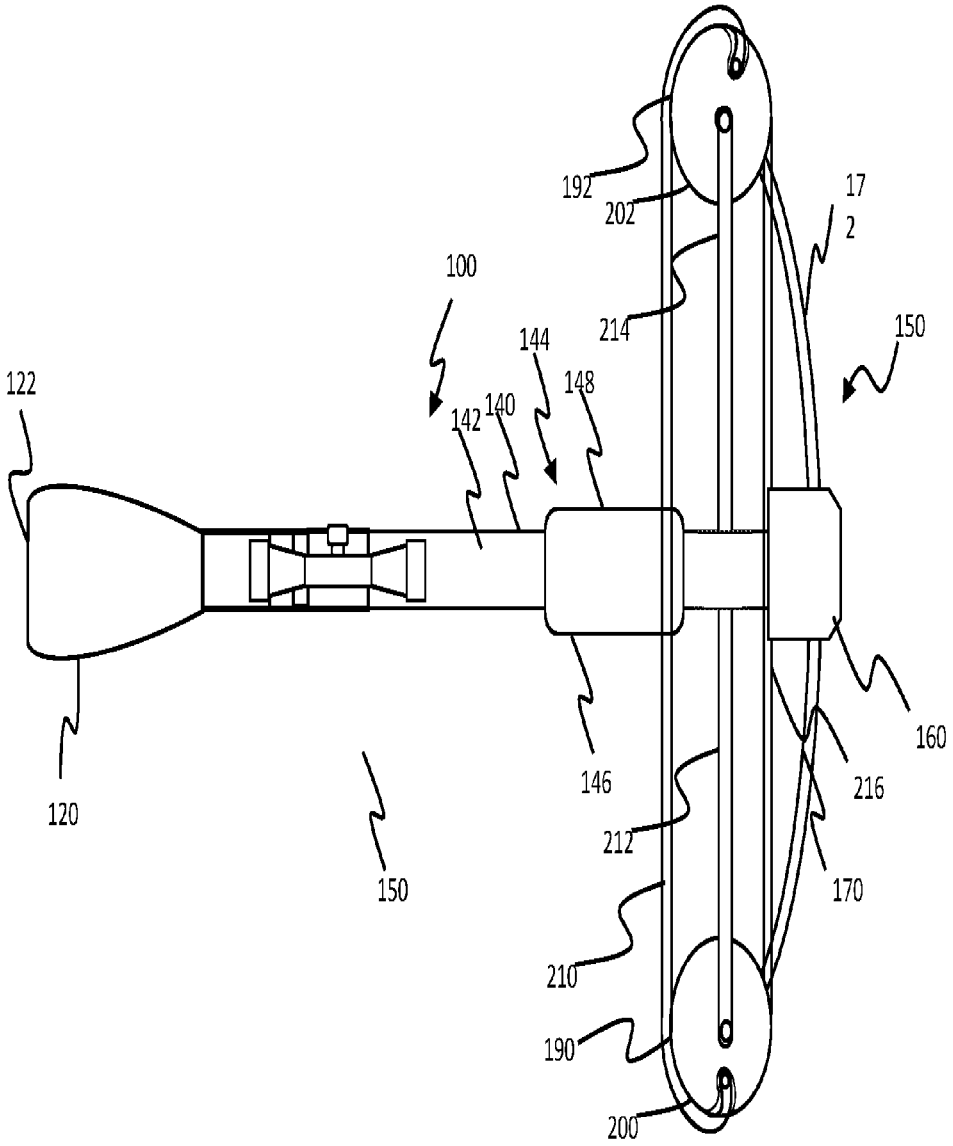
FIG. 3 (Prior Art)
FIG. 3 shows a left side view of the crossbow of FIG. 1.
Figure 4:
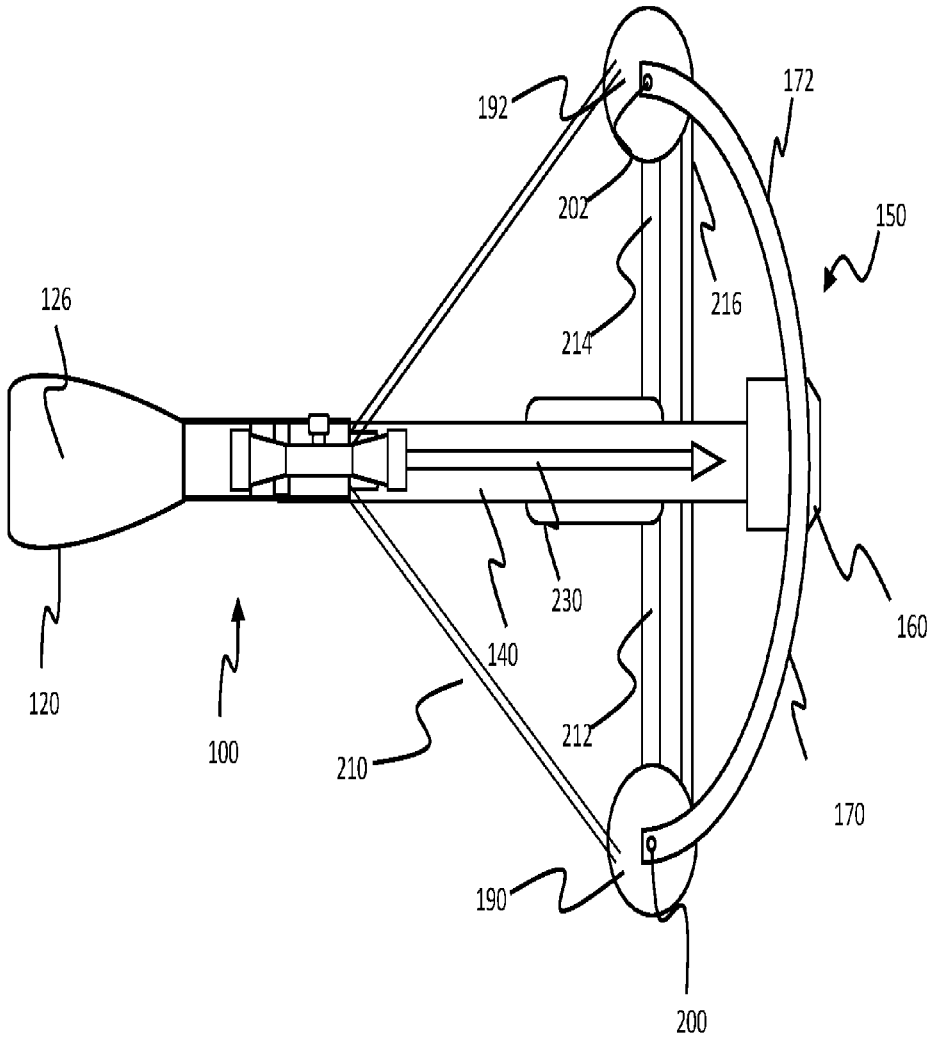
FIG. 4 (Prior Art)

FIG. 4. shows a right side view of the crossbow of FIG. 1 with a string positioned for firing and an arrow on a flight deck.

Figure 5:
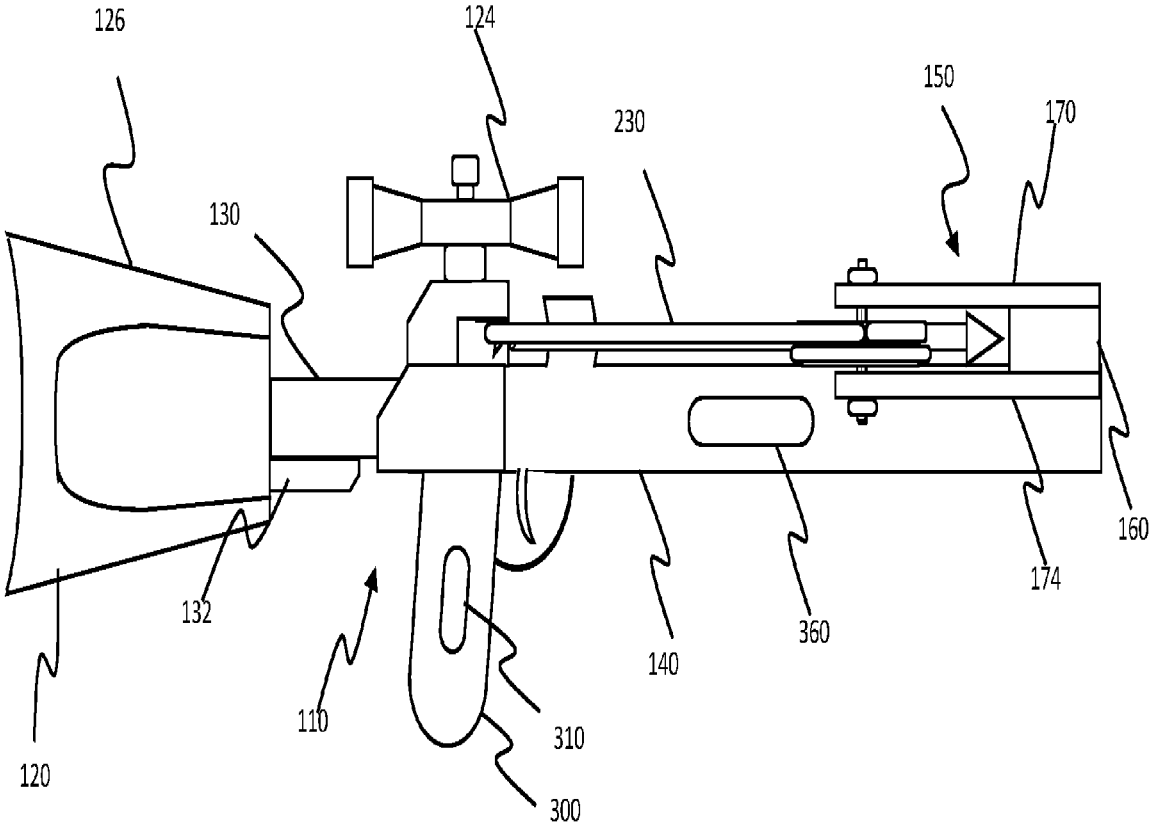
FIG. 5 (Prior Art)

FIG. 5 shows a top view of the crossbow of FIG. 1 with a string positioned for firing and an arrow on a flight deck.

Figure 6:
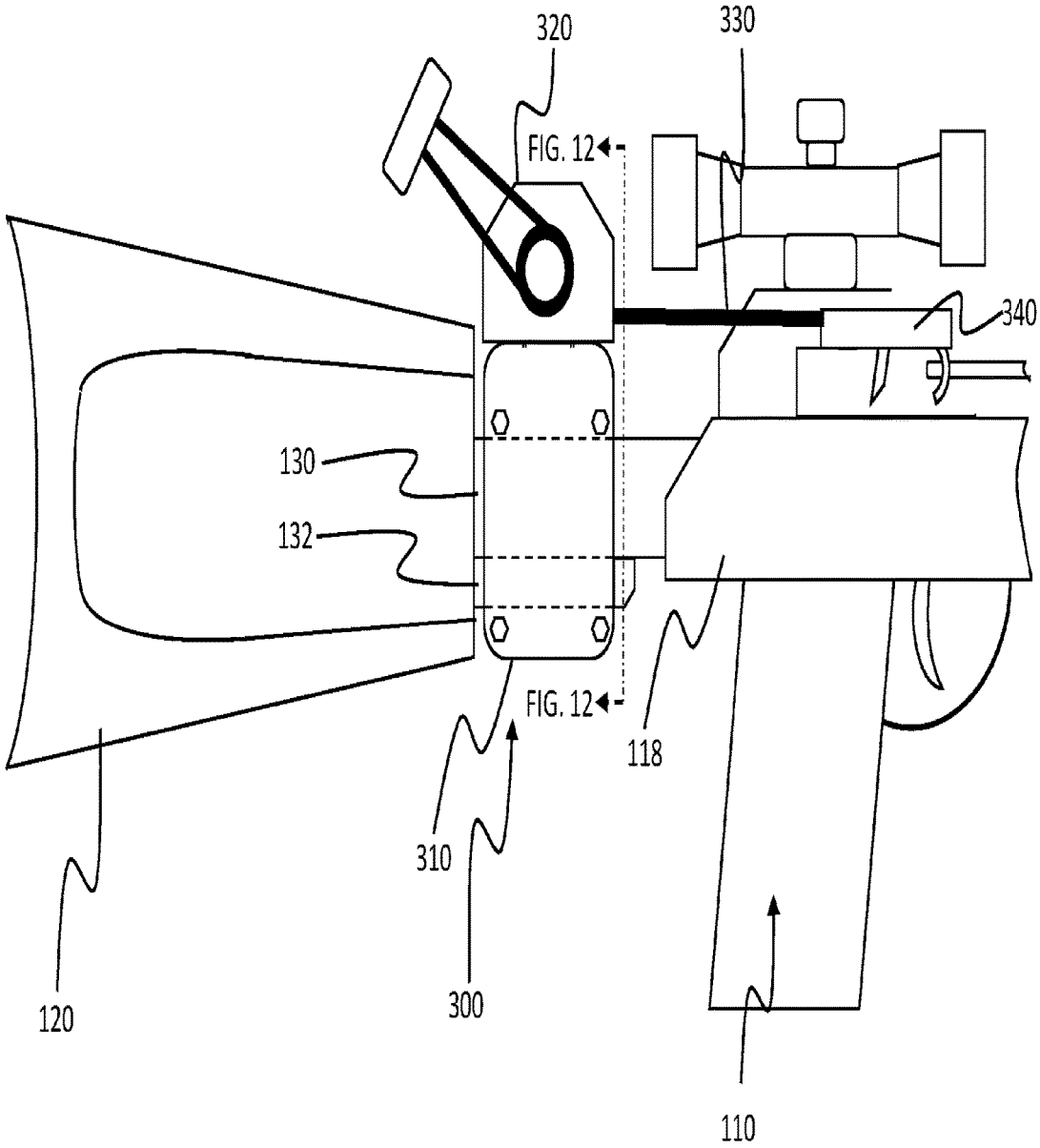

FIG. 6 shows a right side elevation view of a first embodiment of a crossbow bowstring positioning system mounted to a crossbow shown in a partial cut away view.

Figure 7:
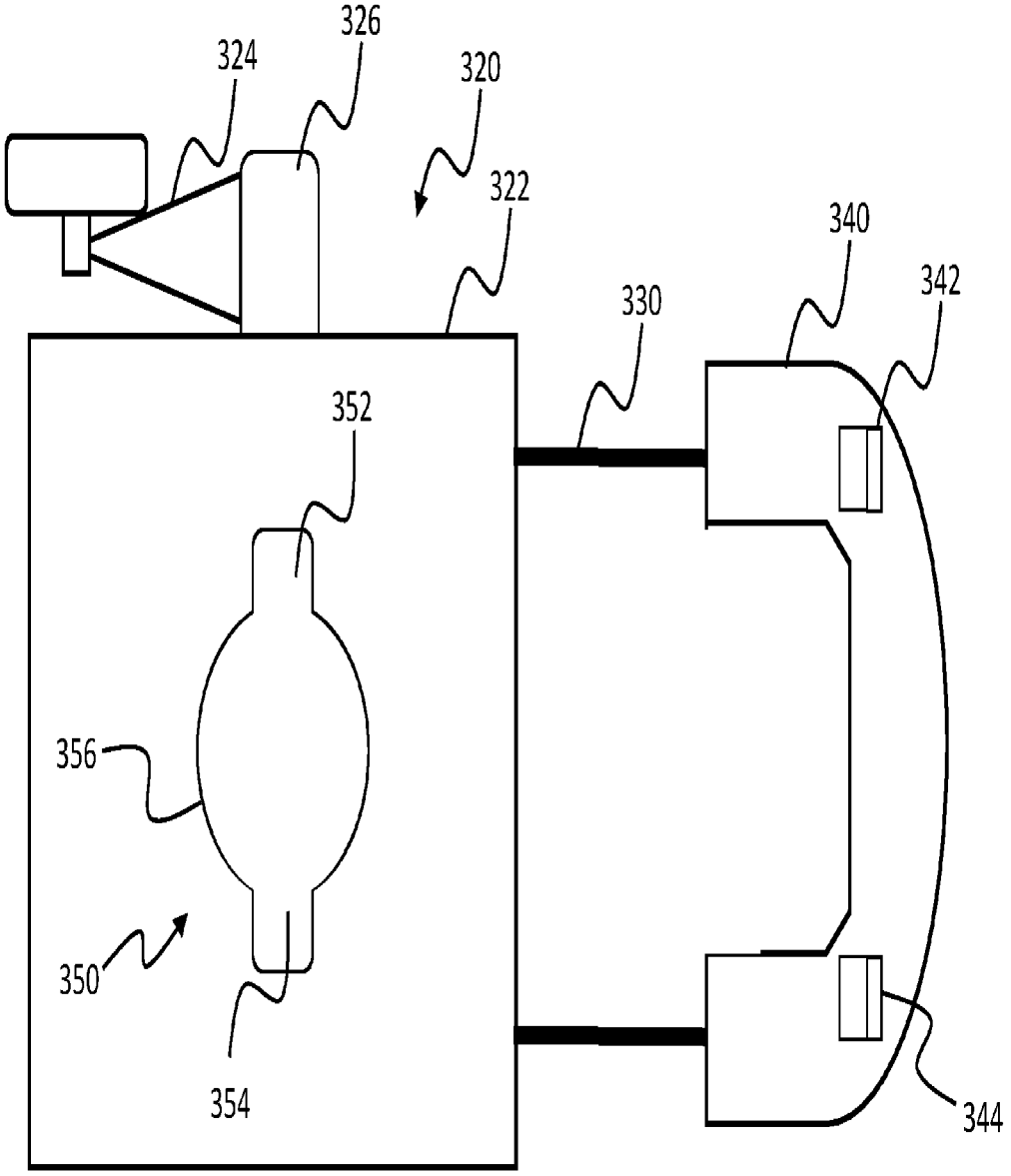

FIG. 7 shows a bottom view of the crossbow bowstring positioning system of FIG. 6.

Figure 8:
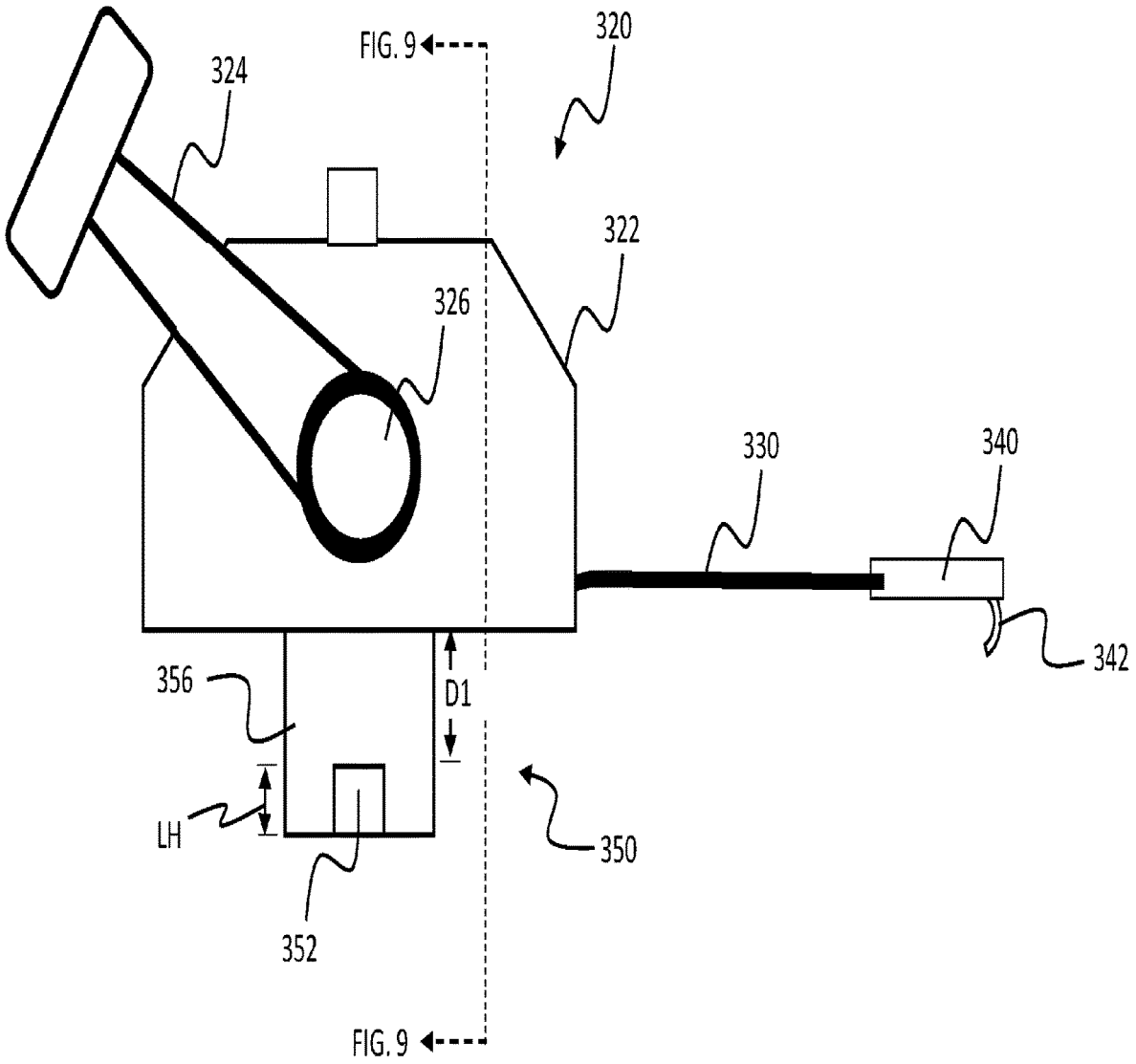

FIG. 8 shows a right side view of the embodiment of FIG. 6.

Figure 9:
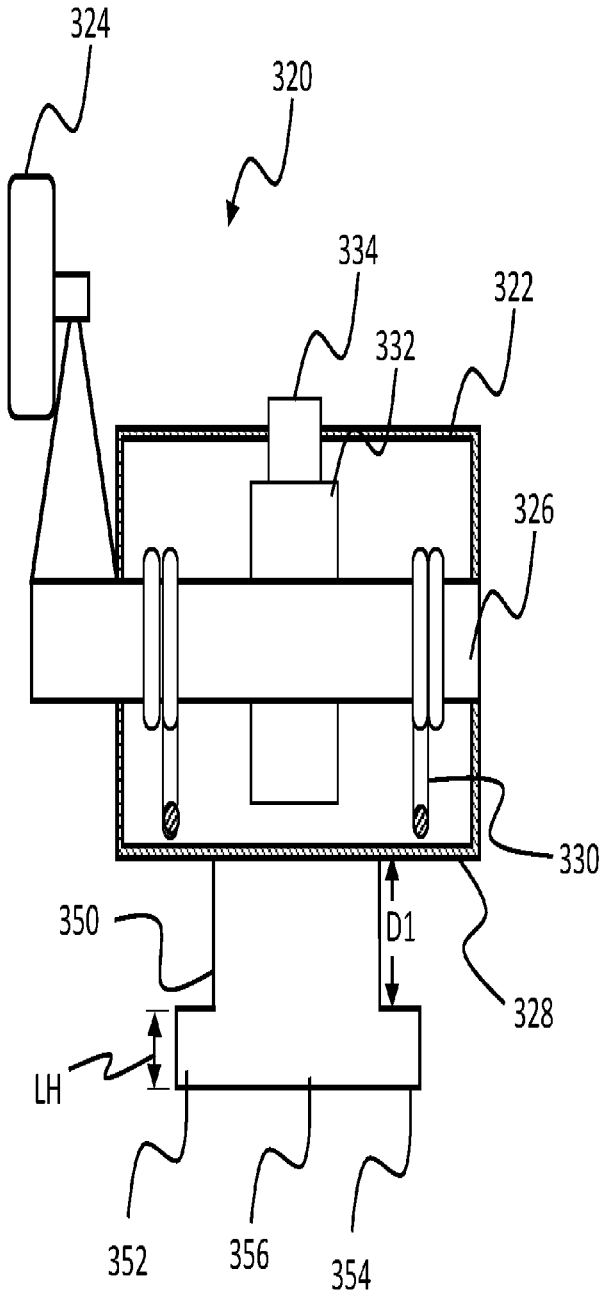

FIG. 9 shows a front section view of the embodiment of FIG. 6 taken as illustrated in FIG. 8

Figure 10:
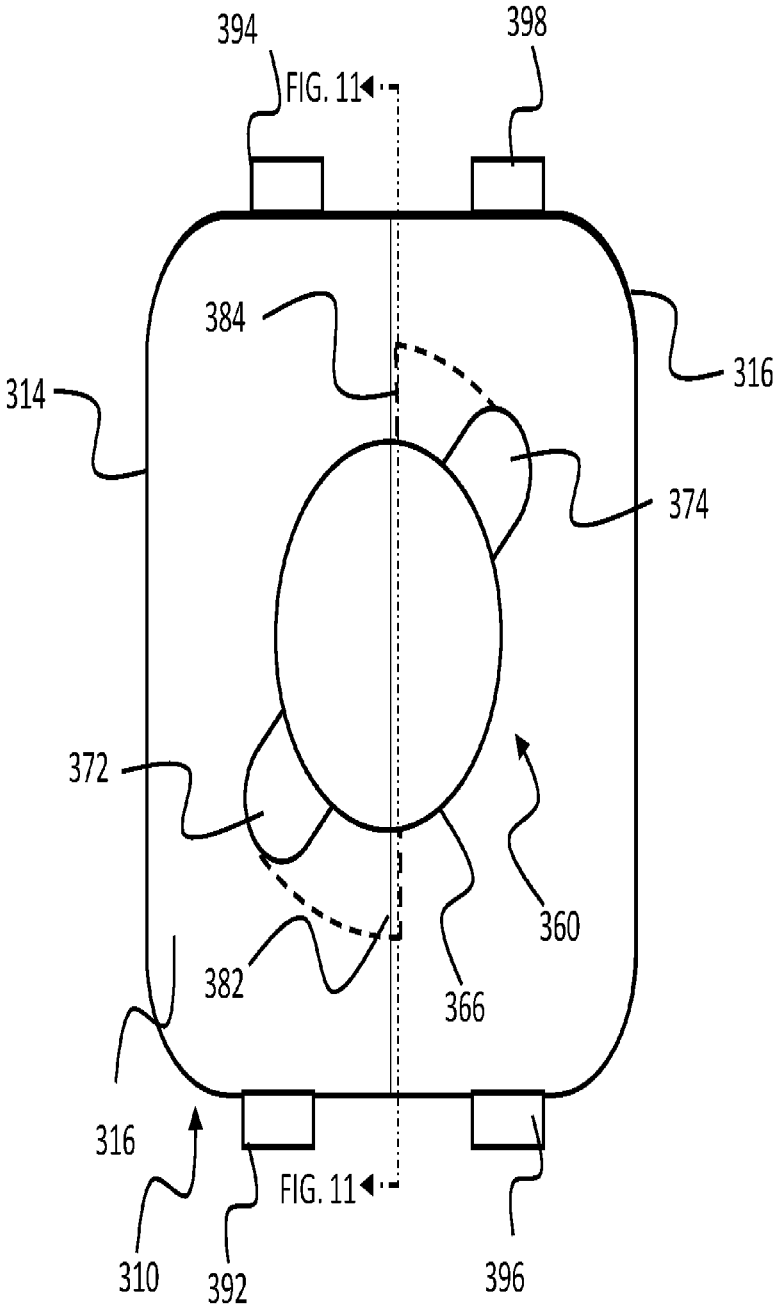

FIG. 10 shows a top view of a mounting of the embodiment of FIG. 6.

Figure 11:
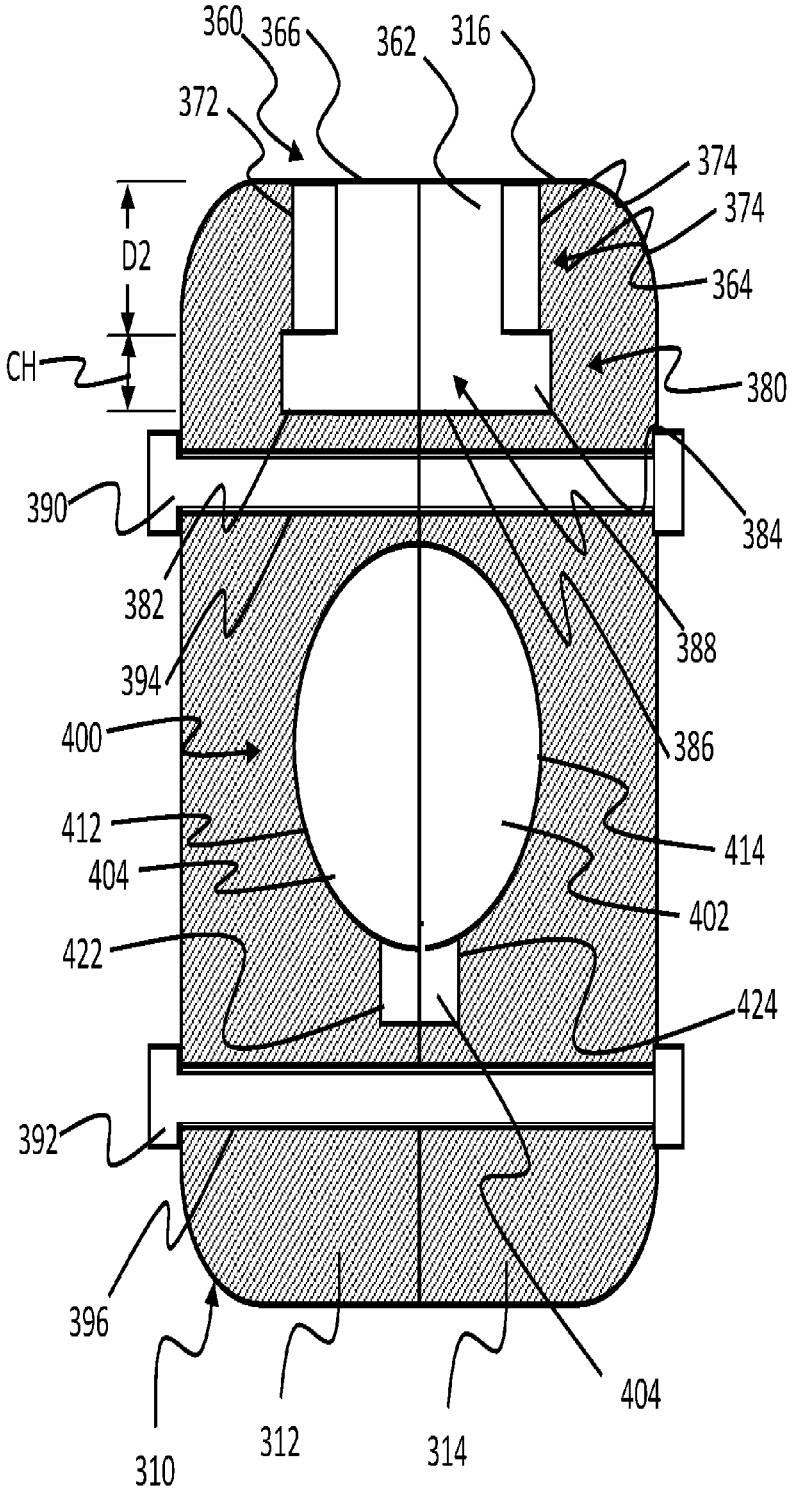

FIG. 11 illustrates a cross-section of the mounting of the embodiment of FIG. 6 taken as is illustrated in FIG. 10.

Figure 12:
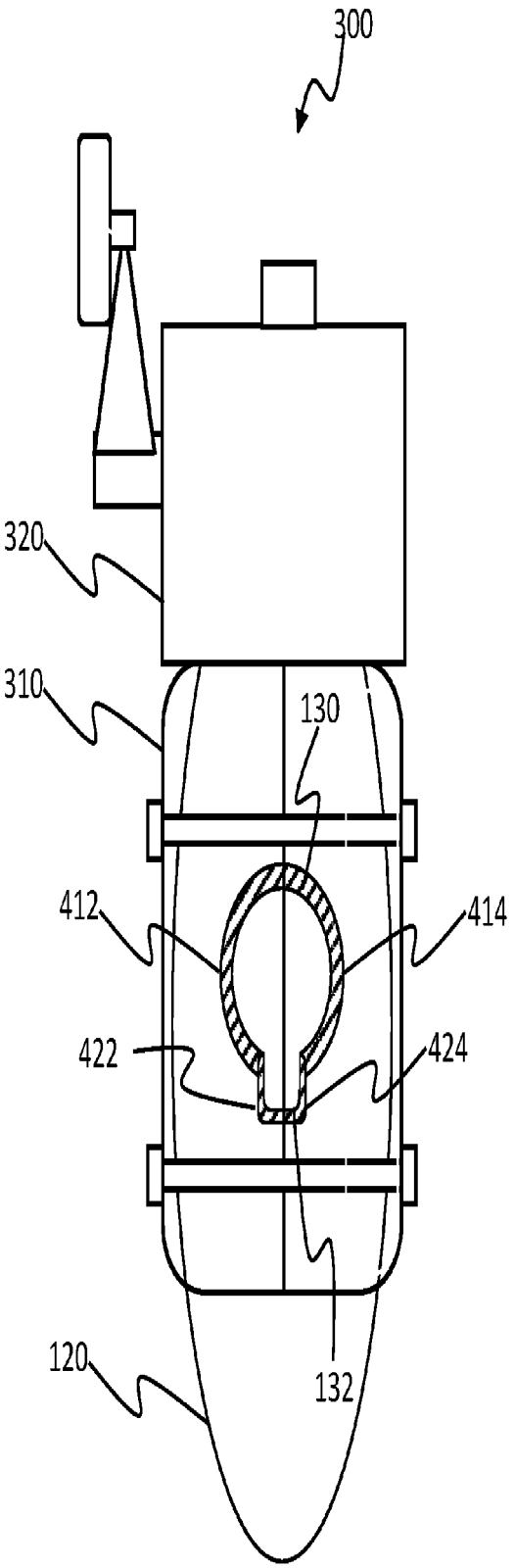

FIG. 12 illustrates the mounting and rope cranking module of FIGS. 6-11 assembled to mounting and with mounting in turn assembled to a buffer tube and ridge taken in section as is shown in FIG. 6.

Figure 13:
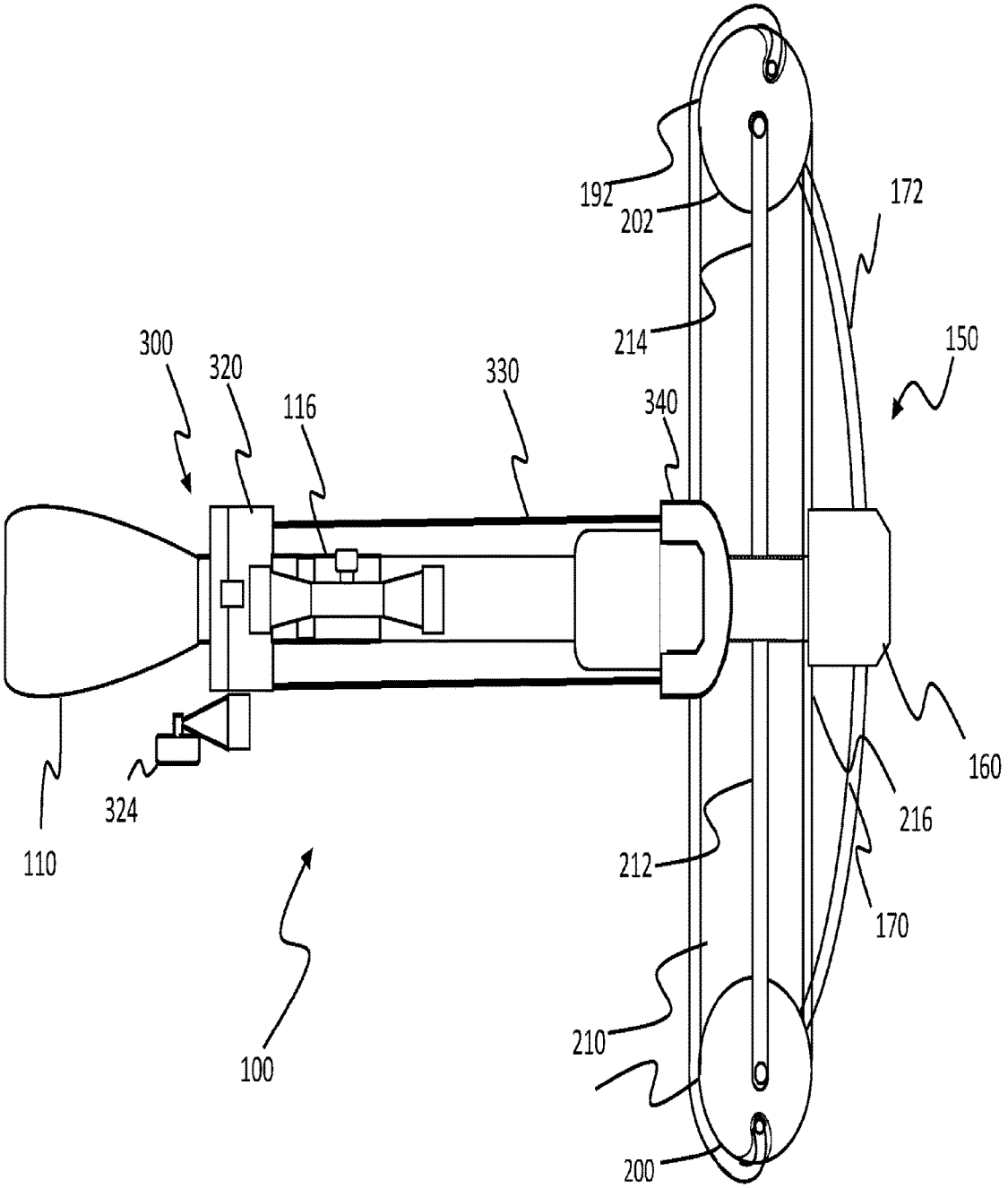

FIG. 13 is a top view of a crossbow and bowstring positioning system when gripping a crossbow bowstring at an initial position thereof.

Figure 14:
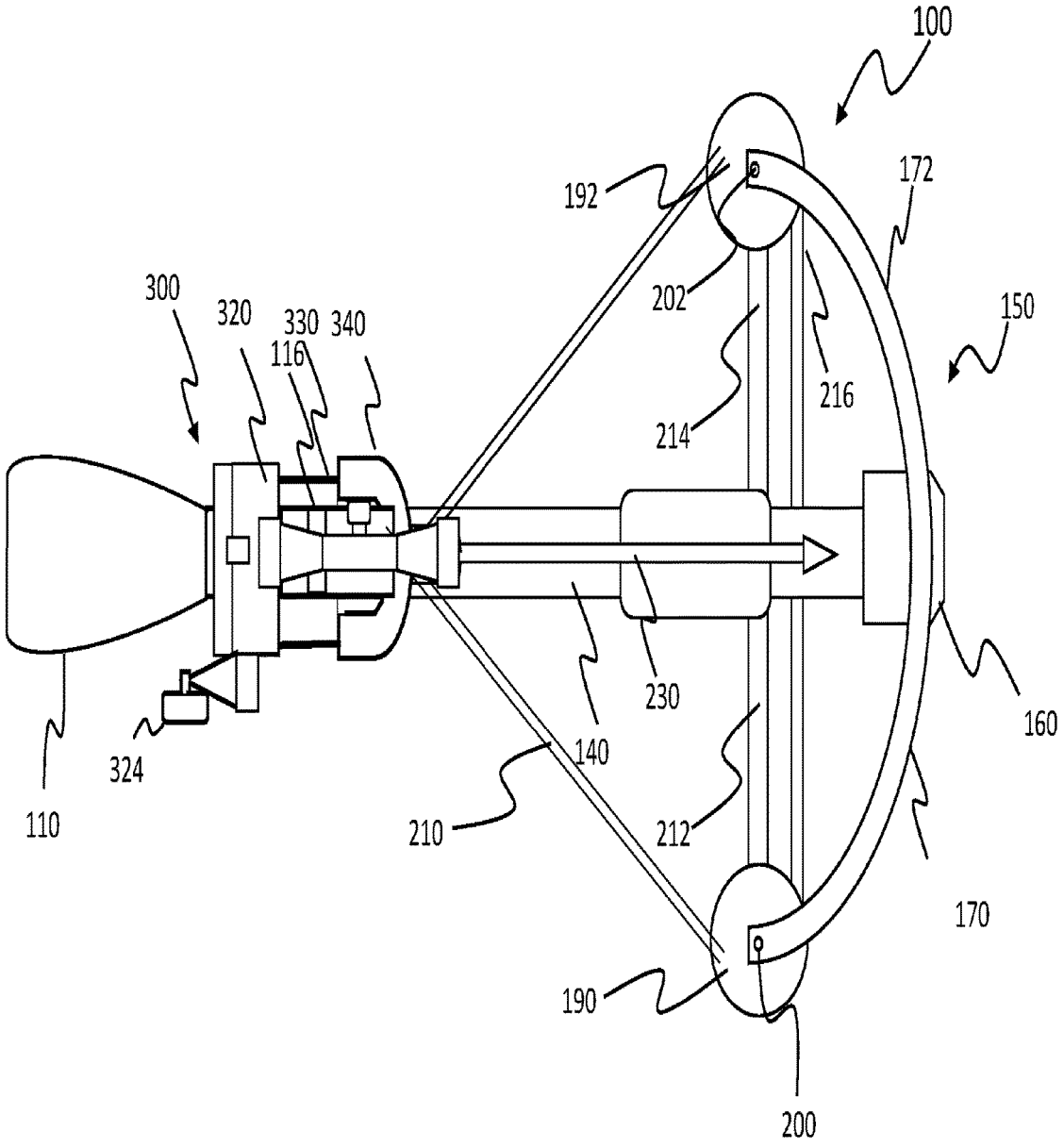

FIG. 14 is a top view of a crossbow and bowstring having adjusted the position of the bowstring using the crossbow bowstring positioning system.

Figure 15:
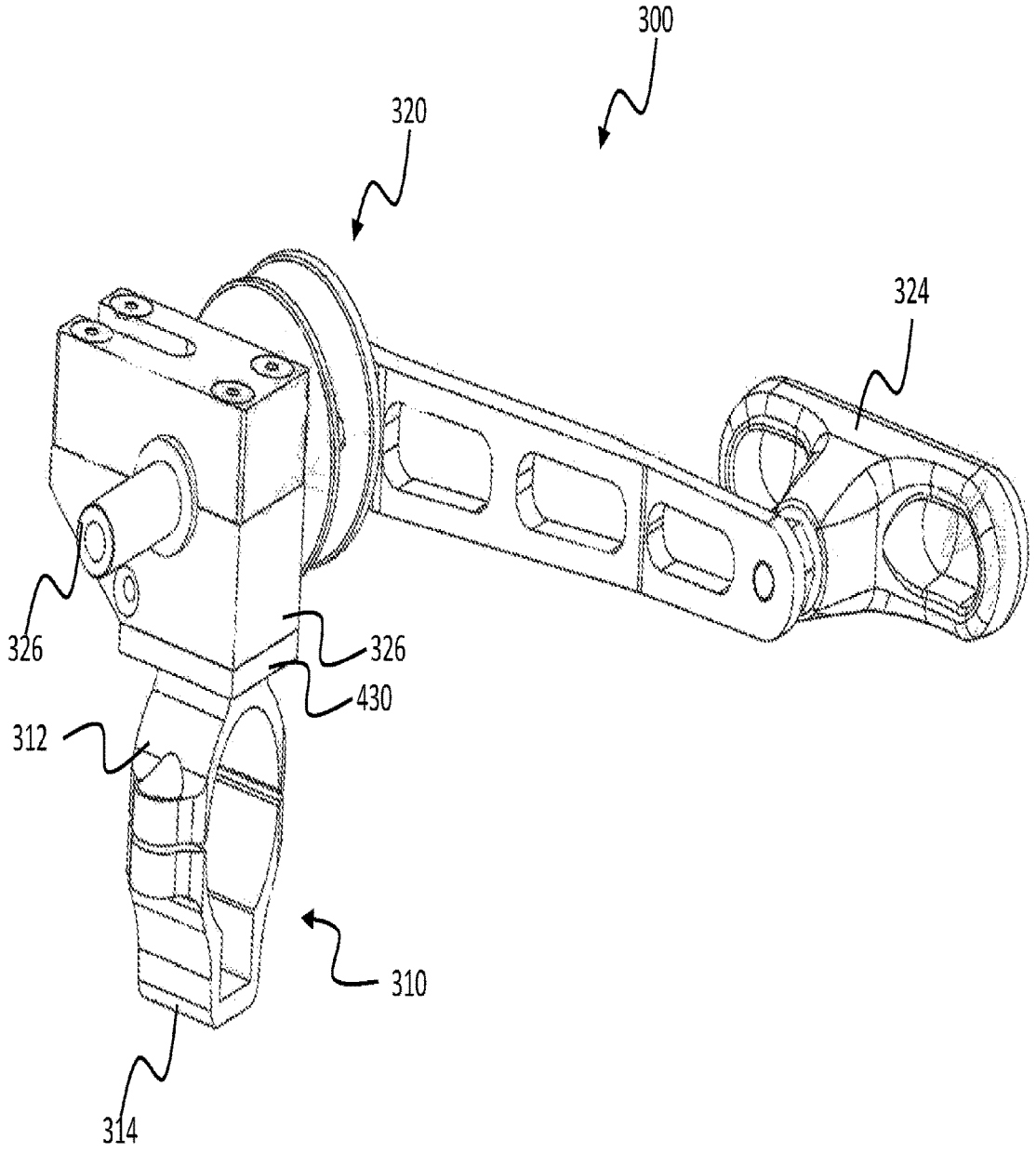

FIG. 15 is a rear, left, top orthogonal and front elevation view of another embodiment of a bowstring positioning system.

Figure 16:
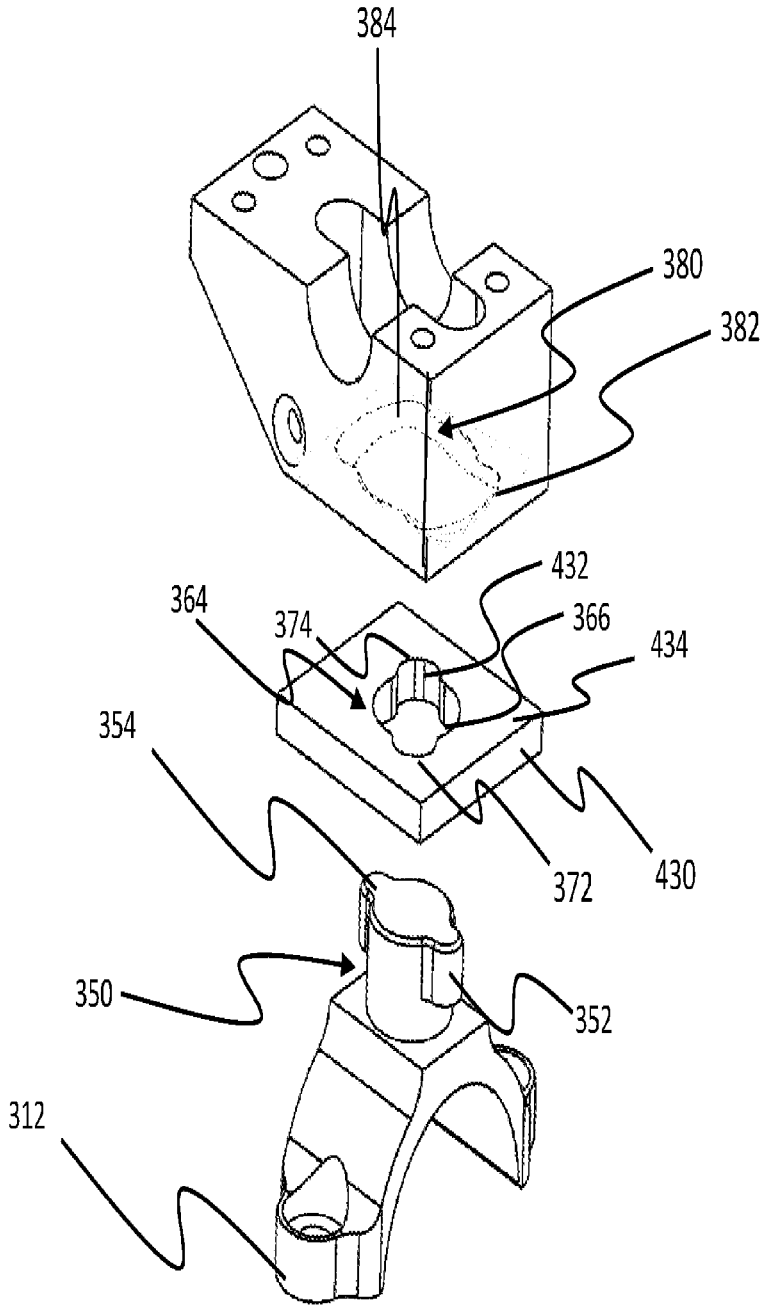

FIG. 16 is an assembly view of the embodiment of FIG. 15 shown in a top, front, right side perspective view.

Figure 17:
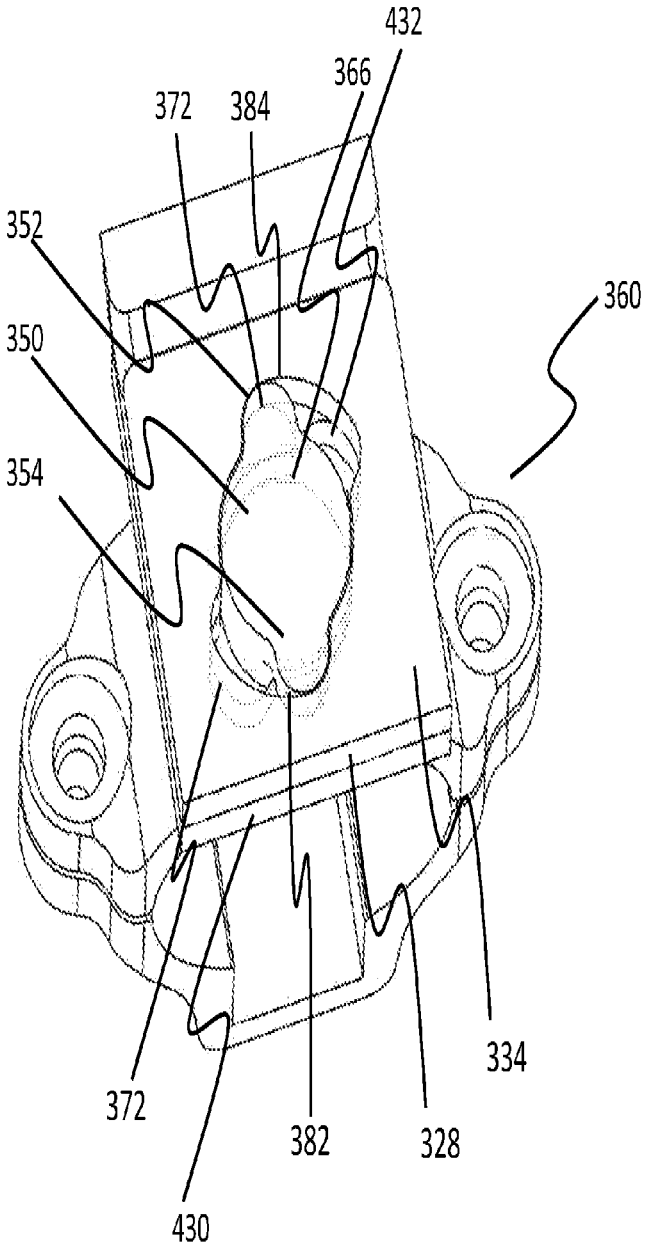

FIG. 17 is a top front right perspective view of the bowstring positioning system of FIG. 15 with components of the bowstring cranking system above a bottom surface cut away.

Figure 18:
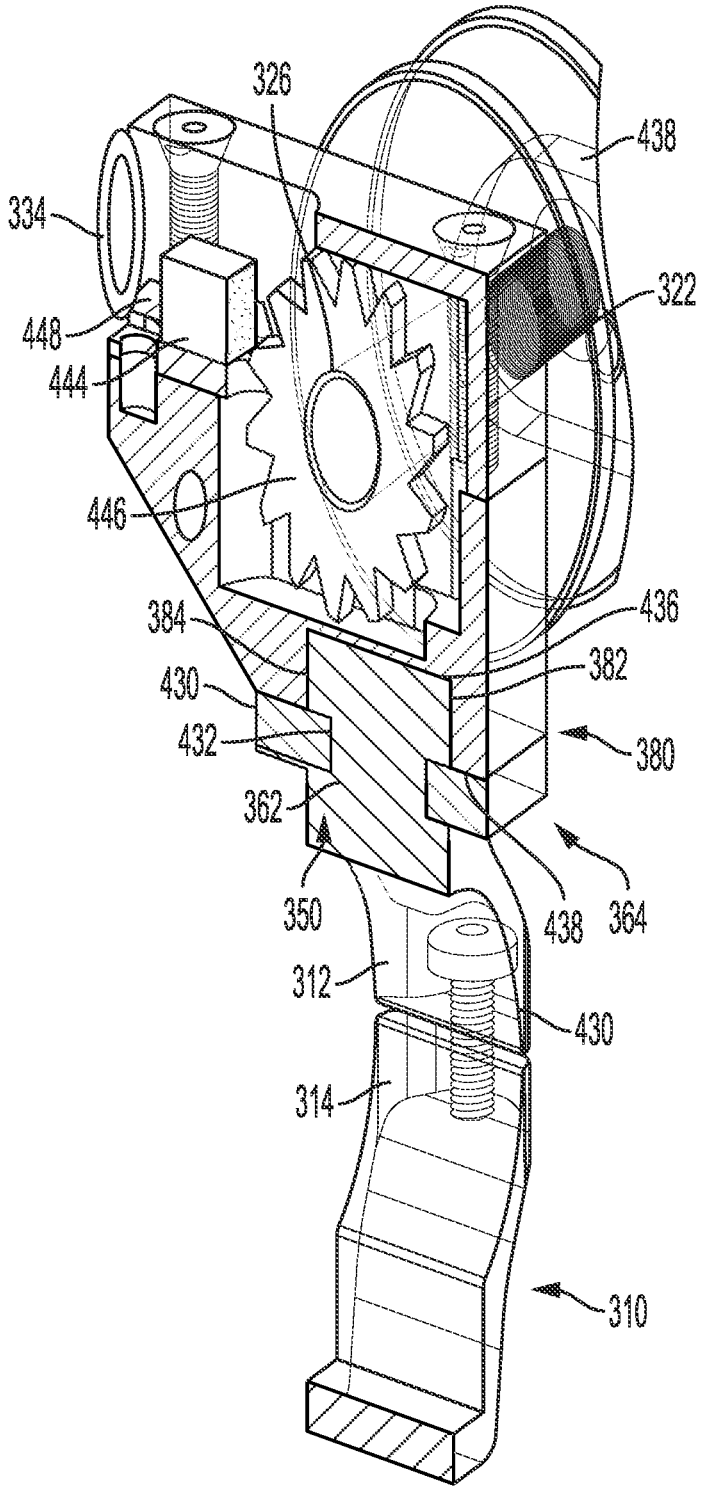

FIG. 18 is a center left facing cross section of the bowstring positioning system of FIG. 15.

Figure 19:
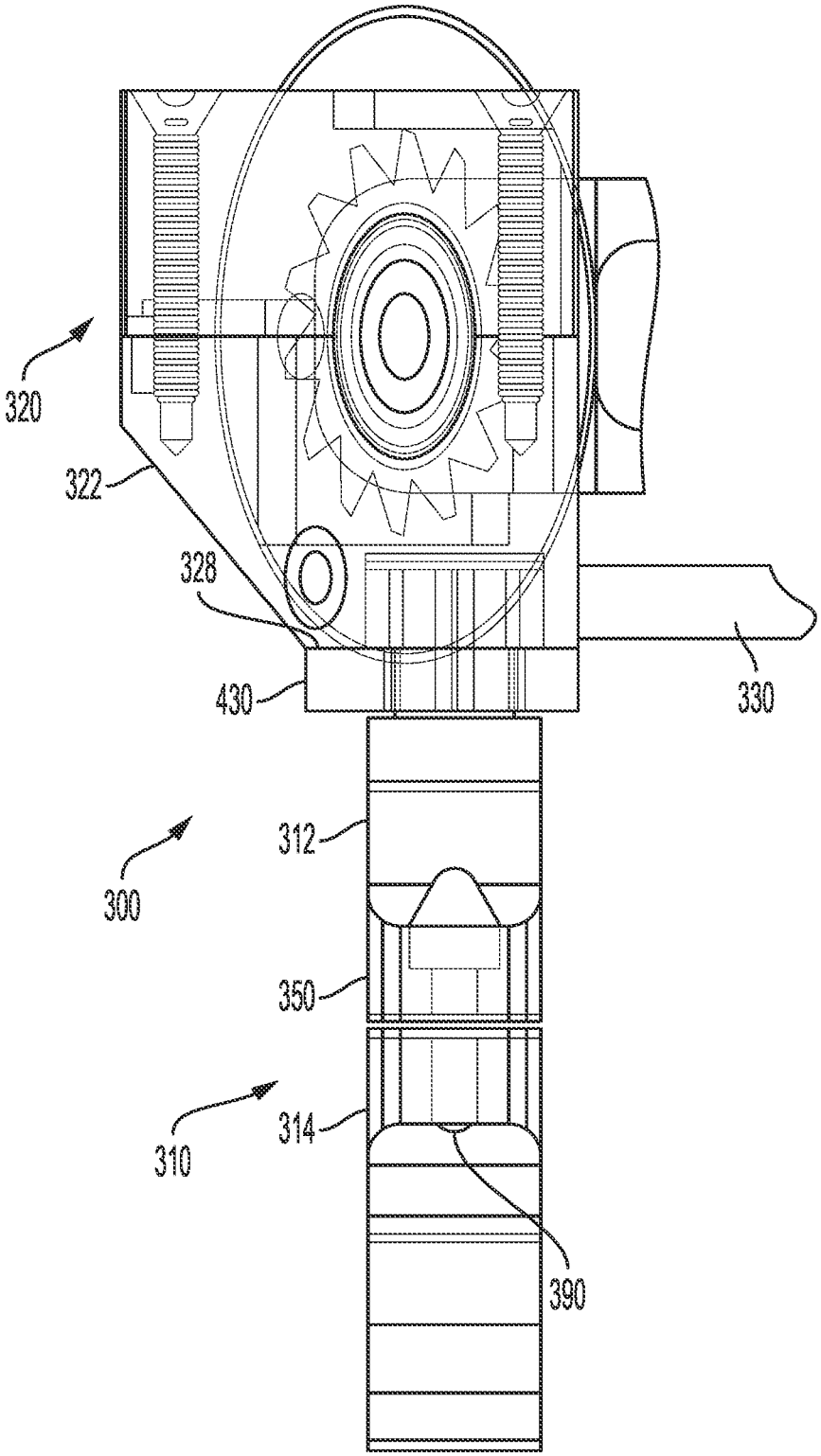

FIG. 19 is a right side elevation view of bowstring positioning system of FIG. 15.

Figure 20:
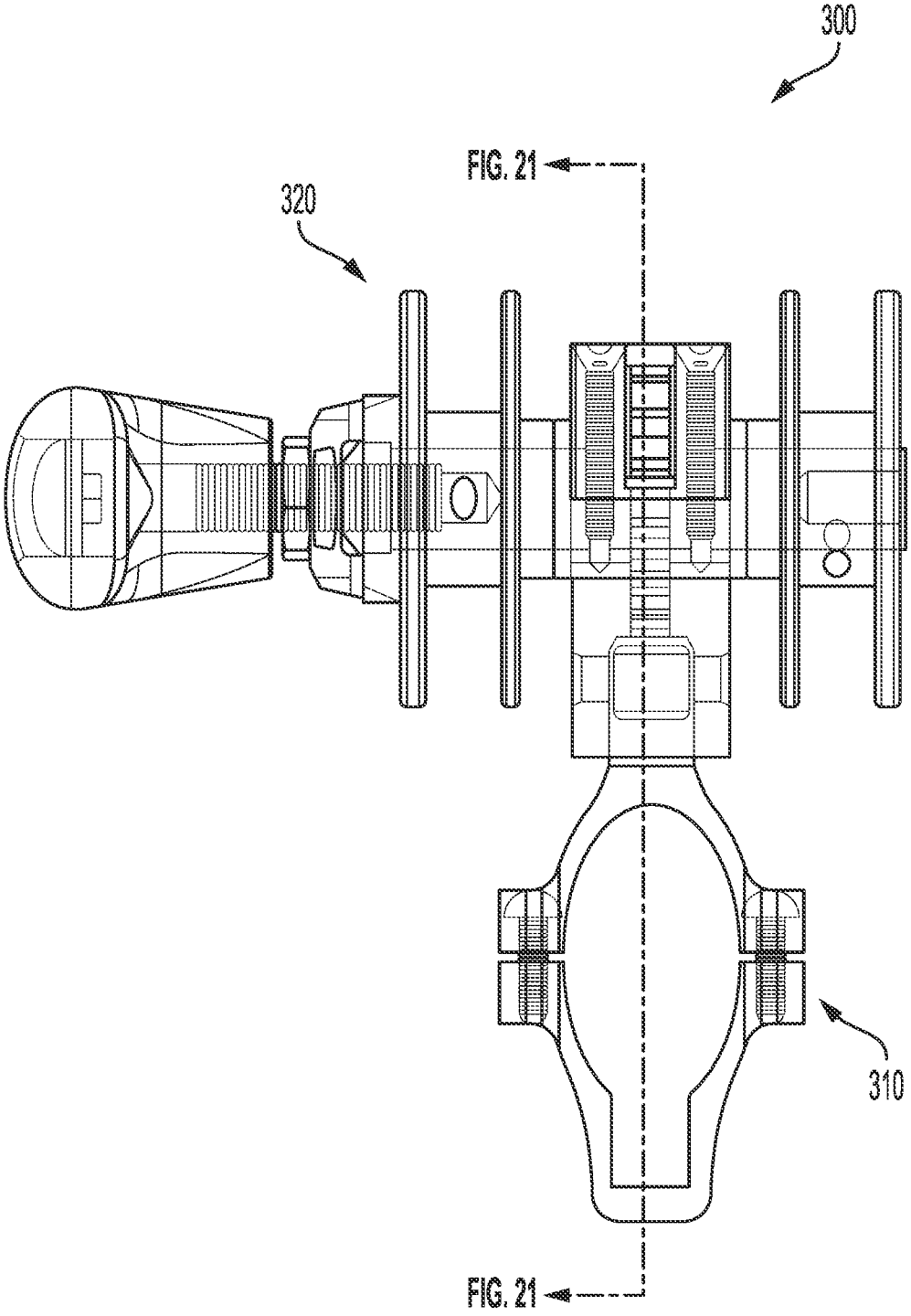

FIG. 20 is a front elevation view of another embodiment of a bowstring positioning system.

Figure 21:
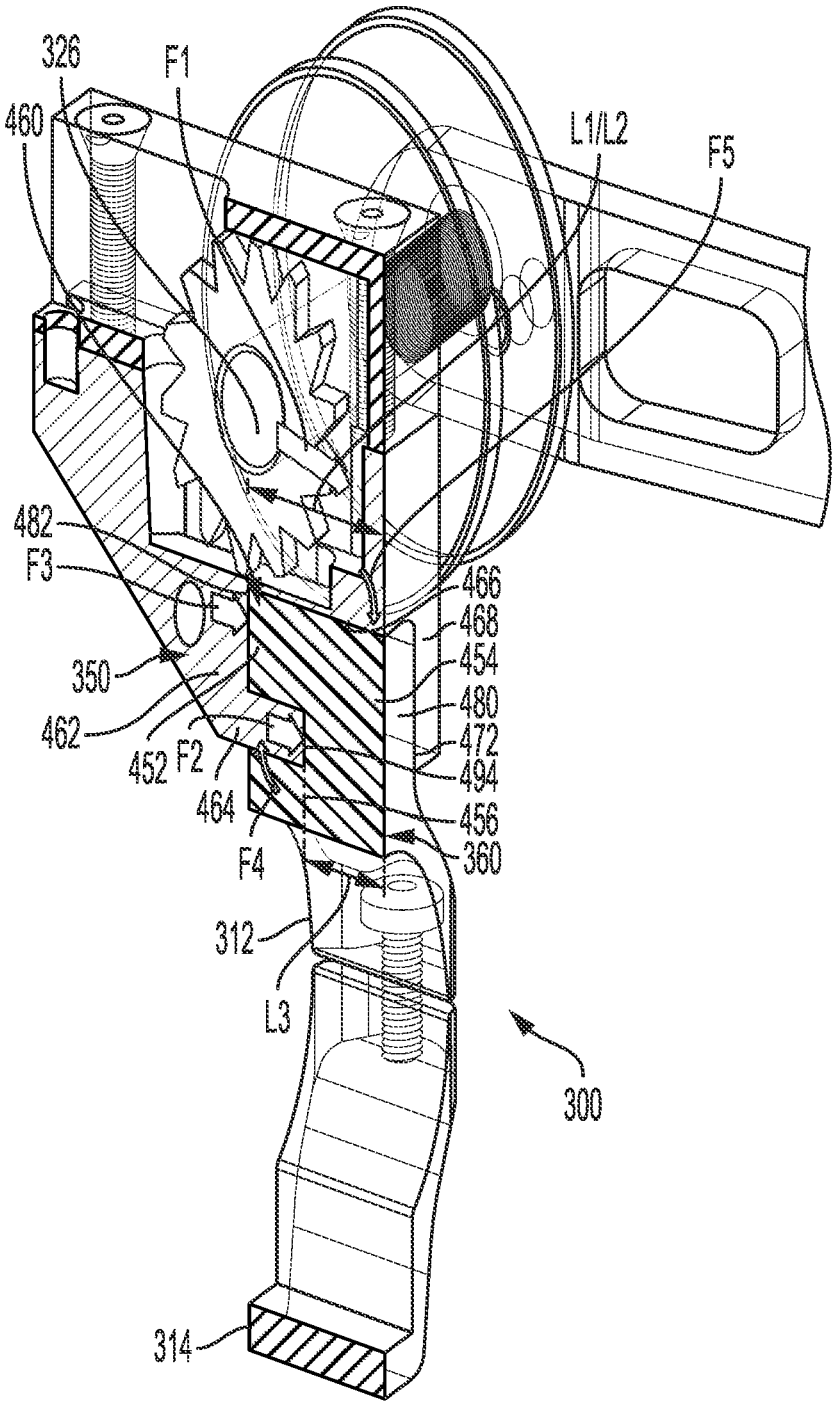

FIG. 21 is a side cross-section view of the embodiment of FIG. 20 taken as illustrated in FIG. 20 and in partial cut away.

Figure 22:
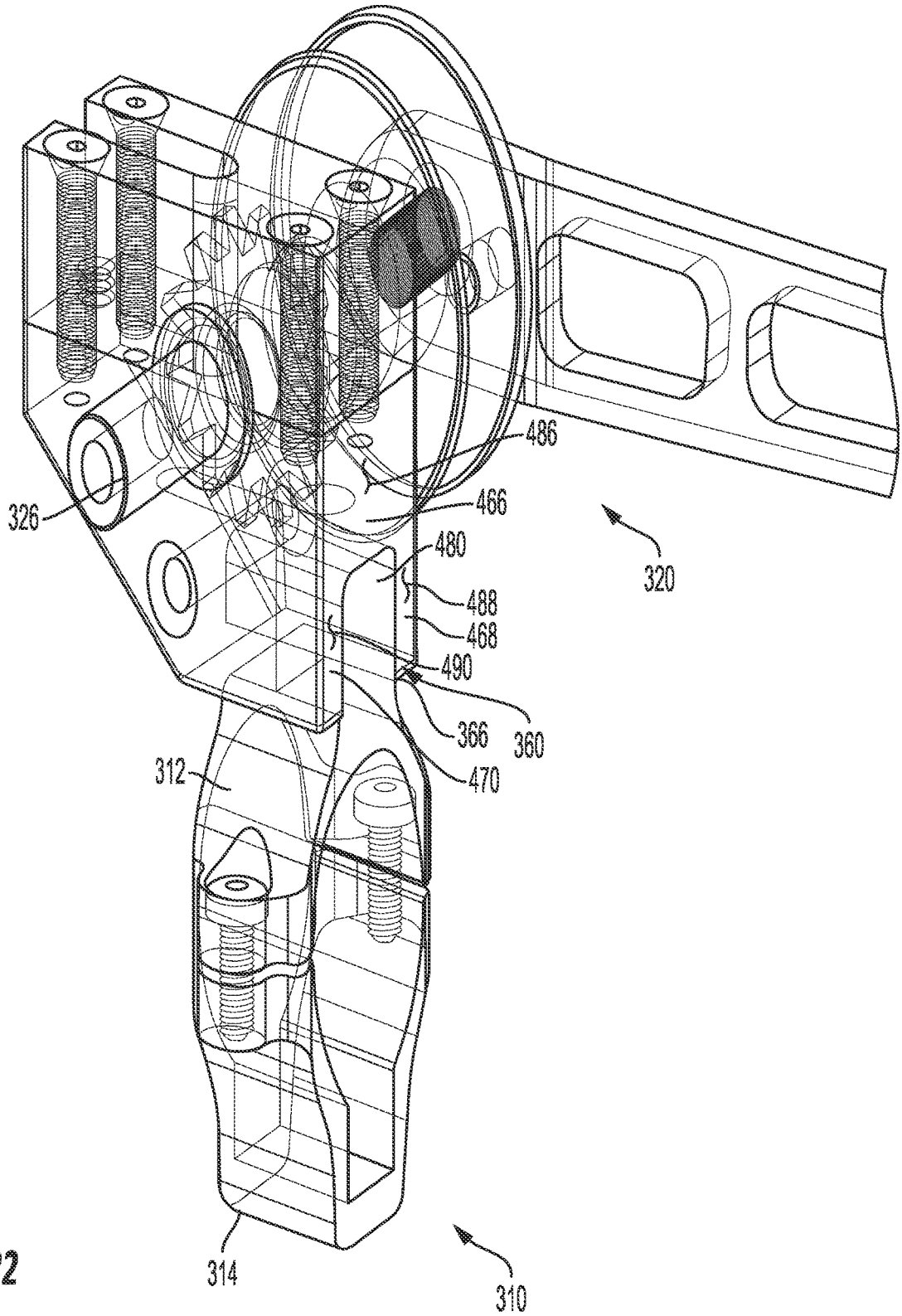

FIG. 22 shows the embodiment of FIG. 20 in a top, front, right side perspective view with a spool removed.

Figure 23:
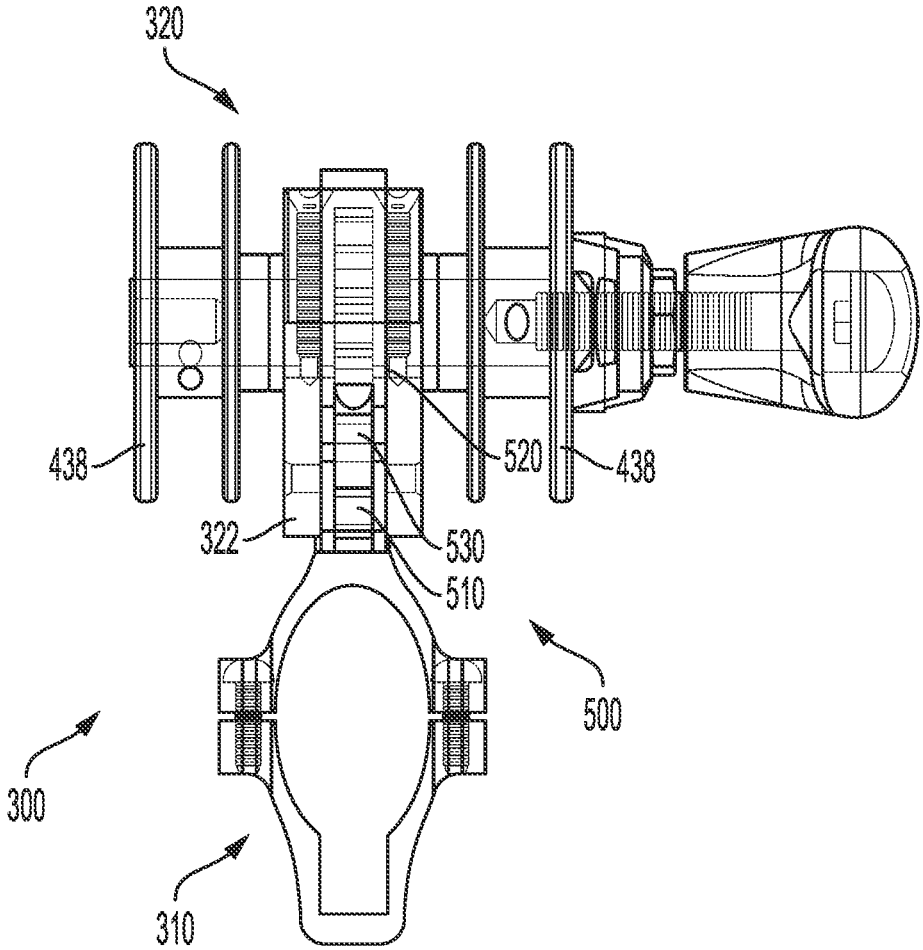

FIG. 23 shows a front elevation view of still another embodiment of bowstring positioning system.

Figure 24:
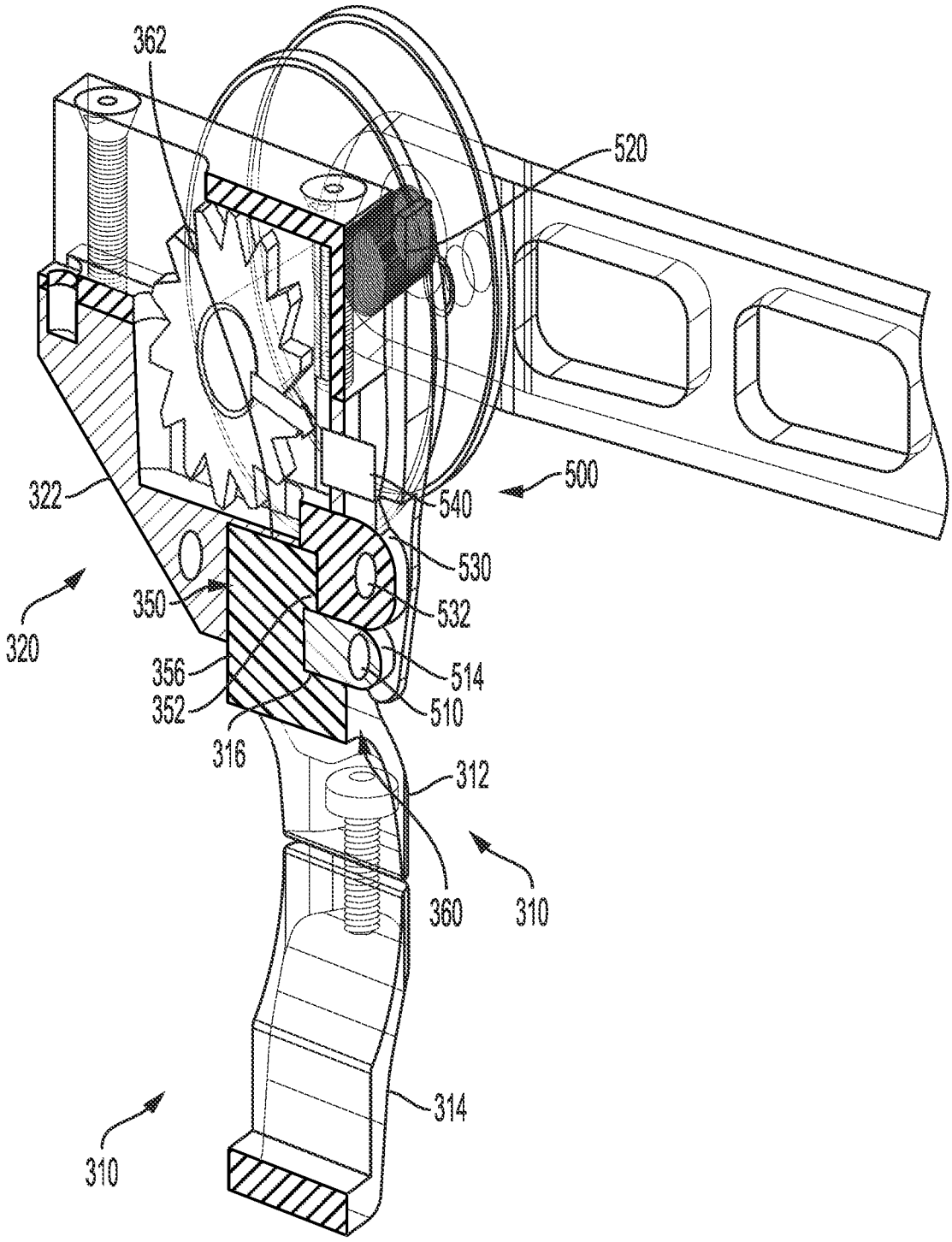

FIG. 24 shows the embodiment of FIG. 23 in partial cross section

Figure 25:
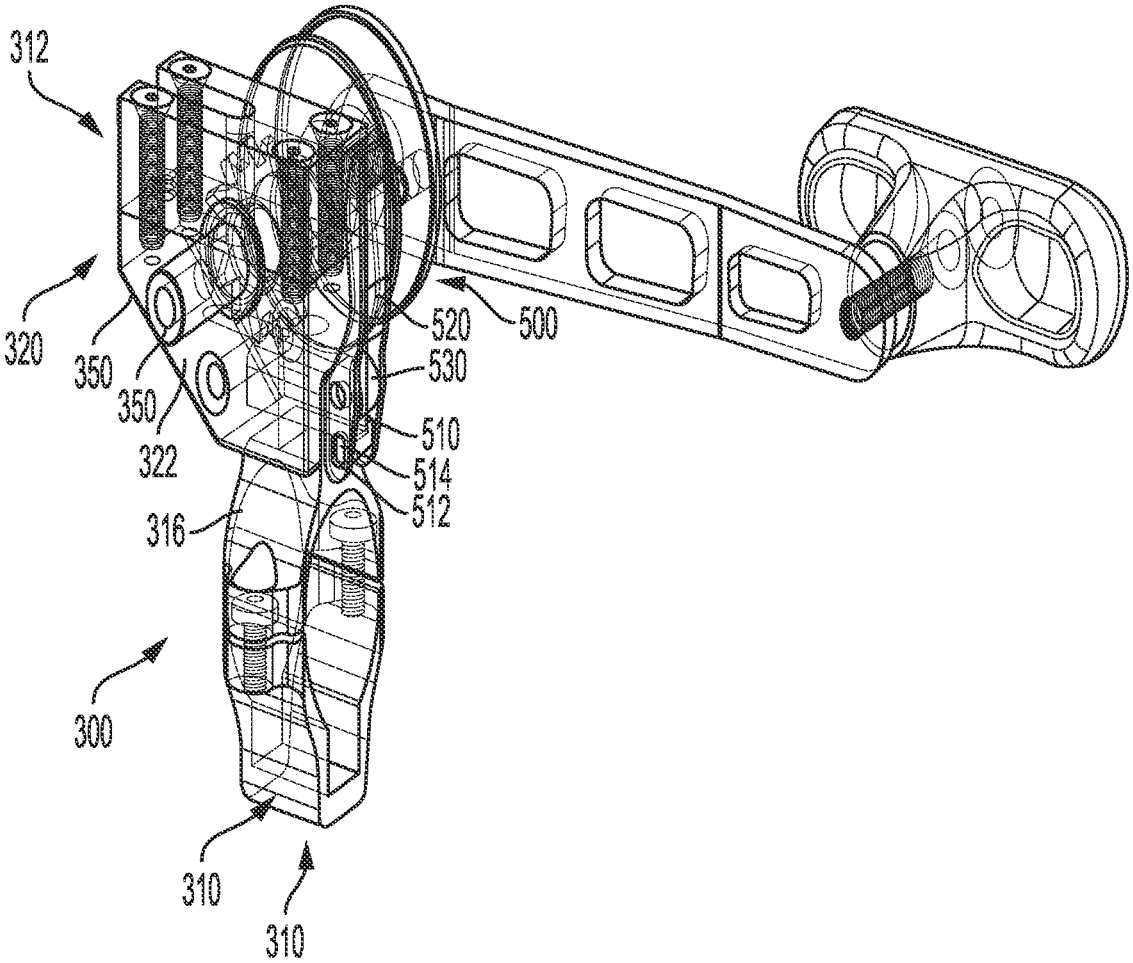

FIG. 25 shows the embodiment of FIG. 23 assembled and in a right, front top perspective with a spool removed.

Figure 26:
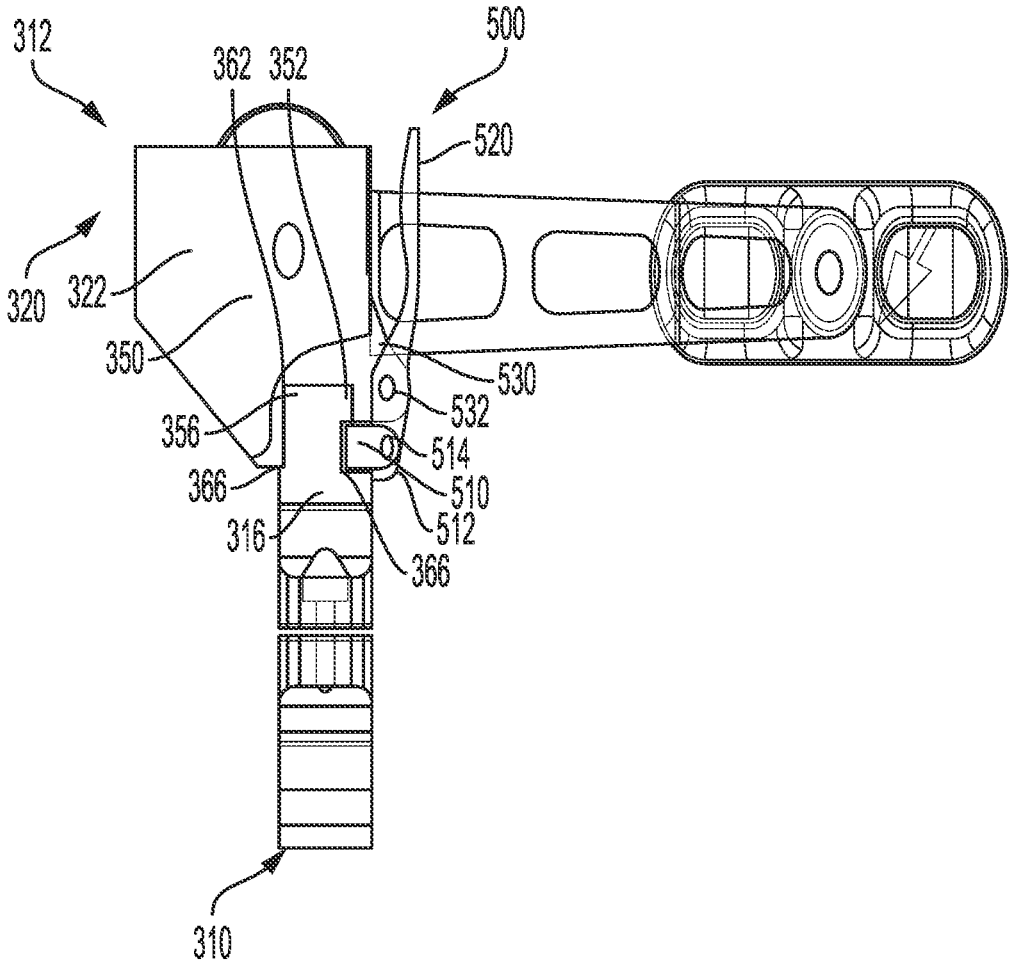

FIG. 26 shows the embodiment of FIG. 23 in a right side elevation with a portion of a housing cut away and a spool removed.

Figure 27:
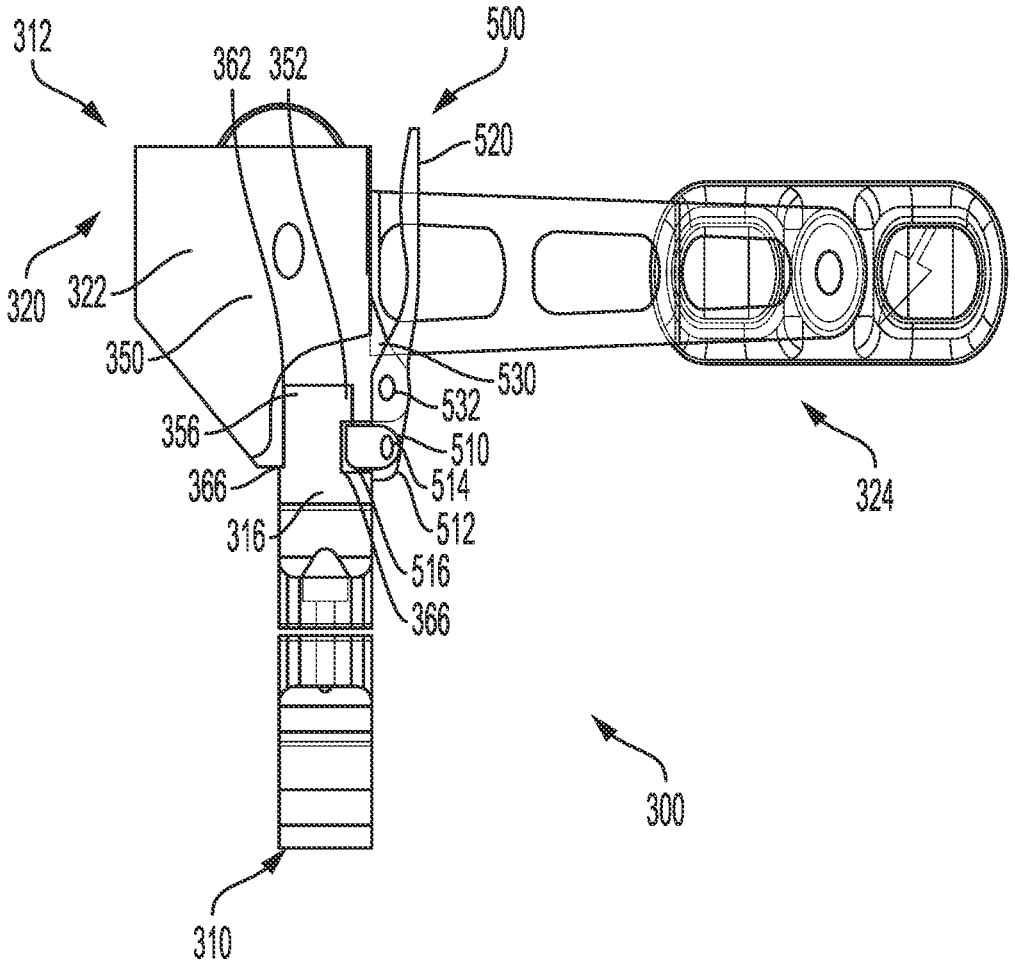

FIG. 27 shows a right side elevation view of shows another embodiment of a bowstring positioning system in partial cut away and a spool removed.

Figure 28:
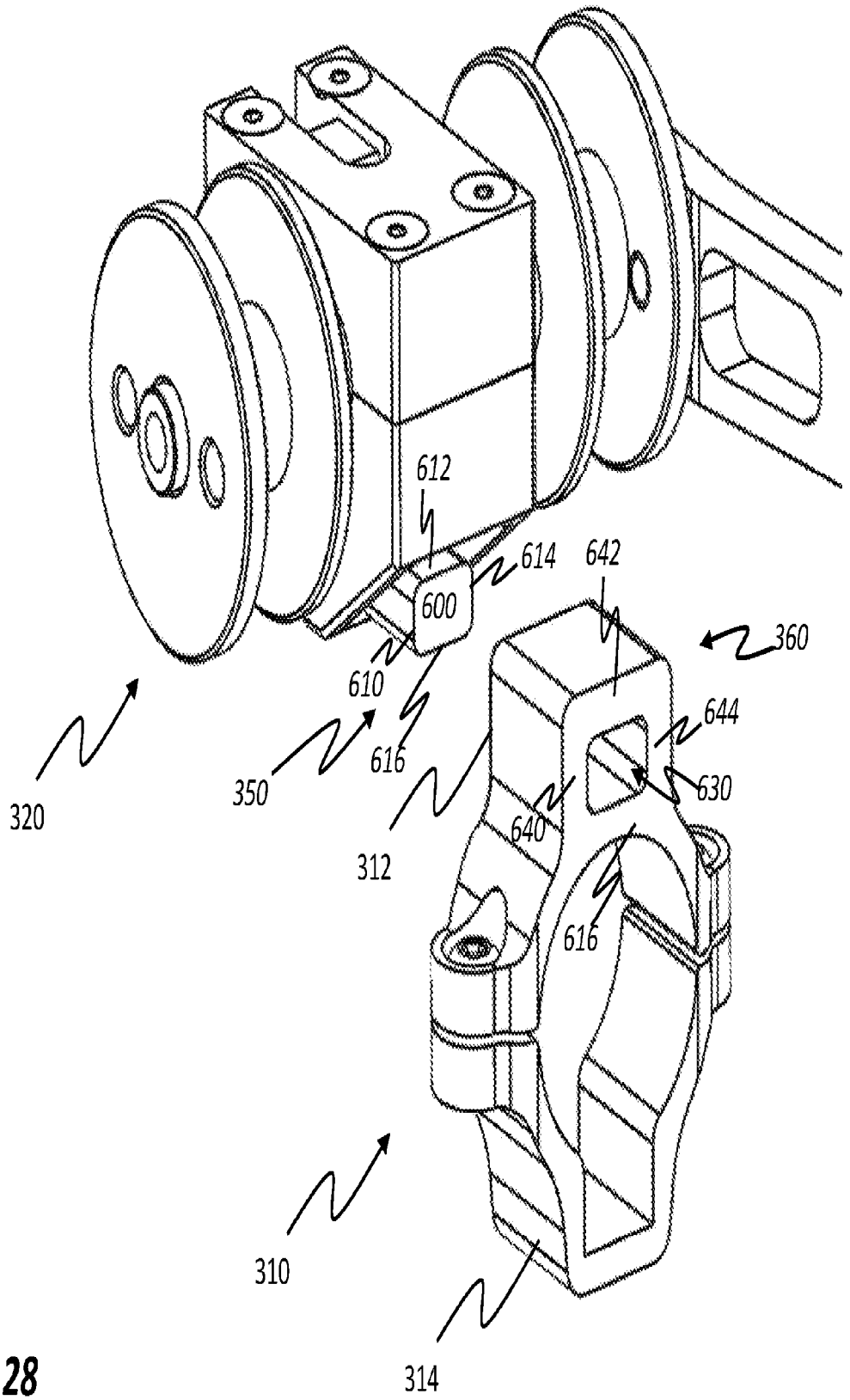

FIG. 28 shows a right, front, top perspective assembly view of yet another embodiment of a crossbow bowstring positioning system.

Figure 29:
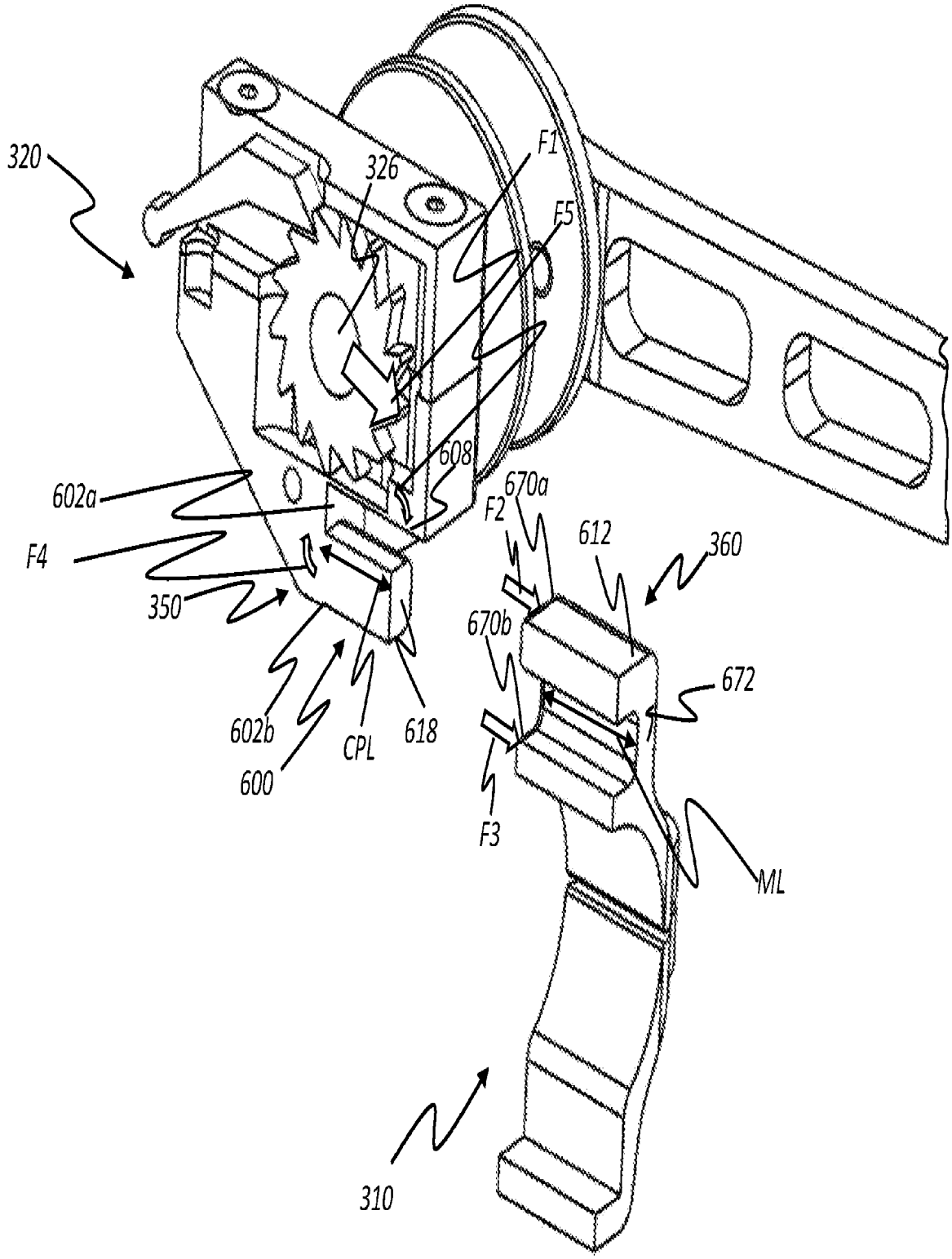

FIG. 29 shows a right, front, top perspective view of the embodiment of FIG. 28, with housing module and mounting shown in section.

Figure 30:
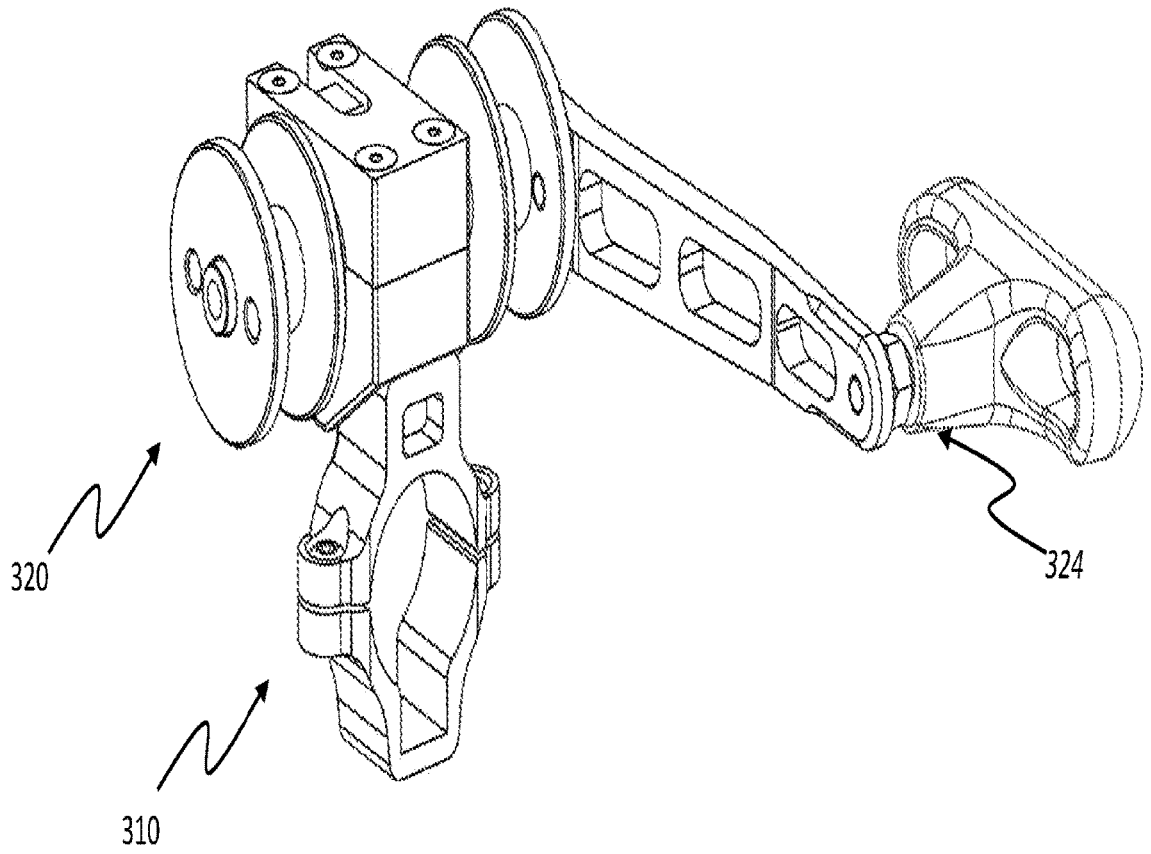

FIG. 30 shows a right, top, front side perspective view of the embodiment of FIG. 28.

Figure 31:
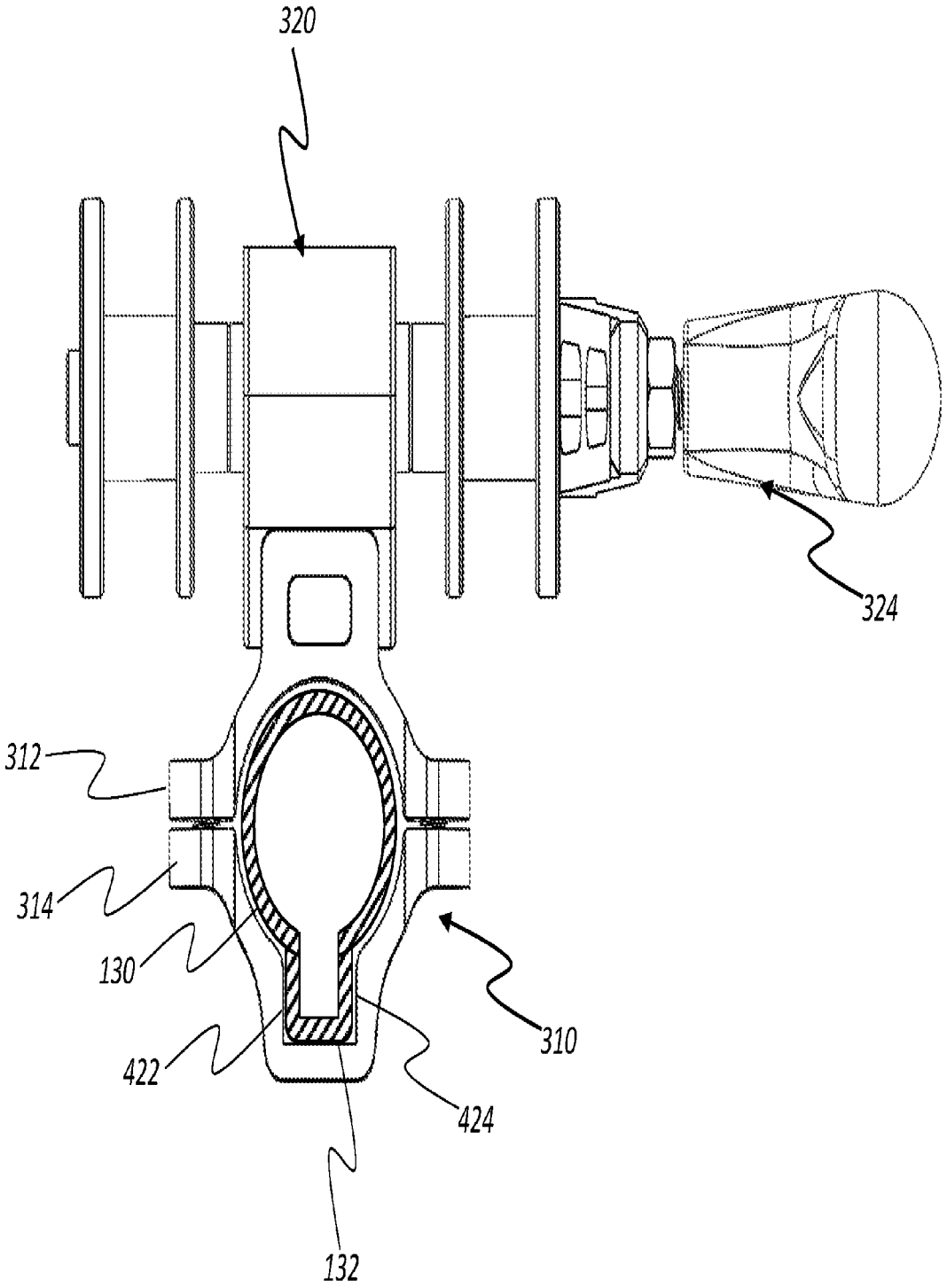

FIG. 31 shows a front elevation view of the embodiment of FIG. 28, with a buffer tube shown in cross section.

Figure 32:
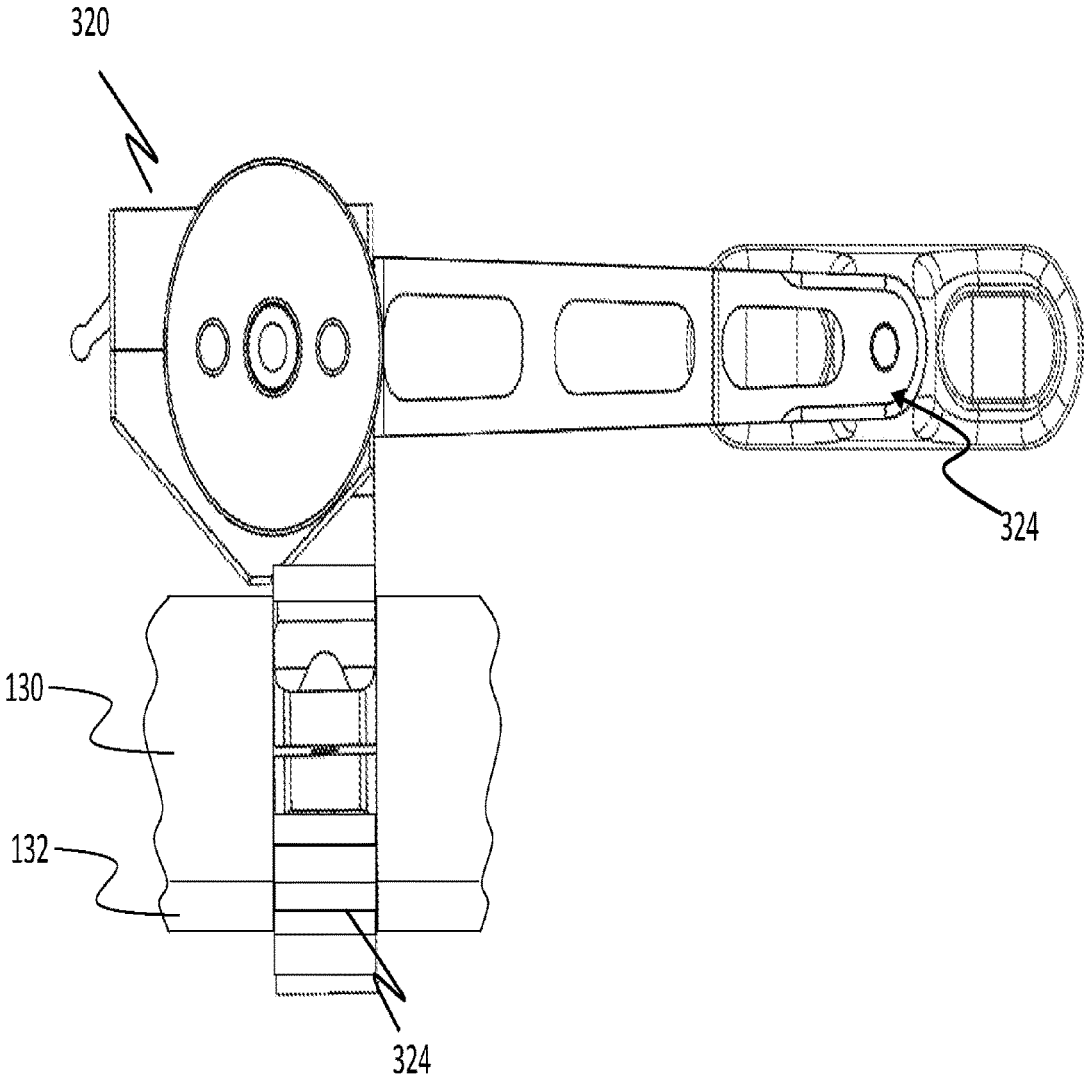

FIG. 32 shows a right side elevation view of the embodiment of FIG. 28 with a cut away view of a buffer tube.

Figure 33:
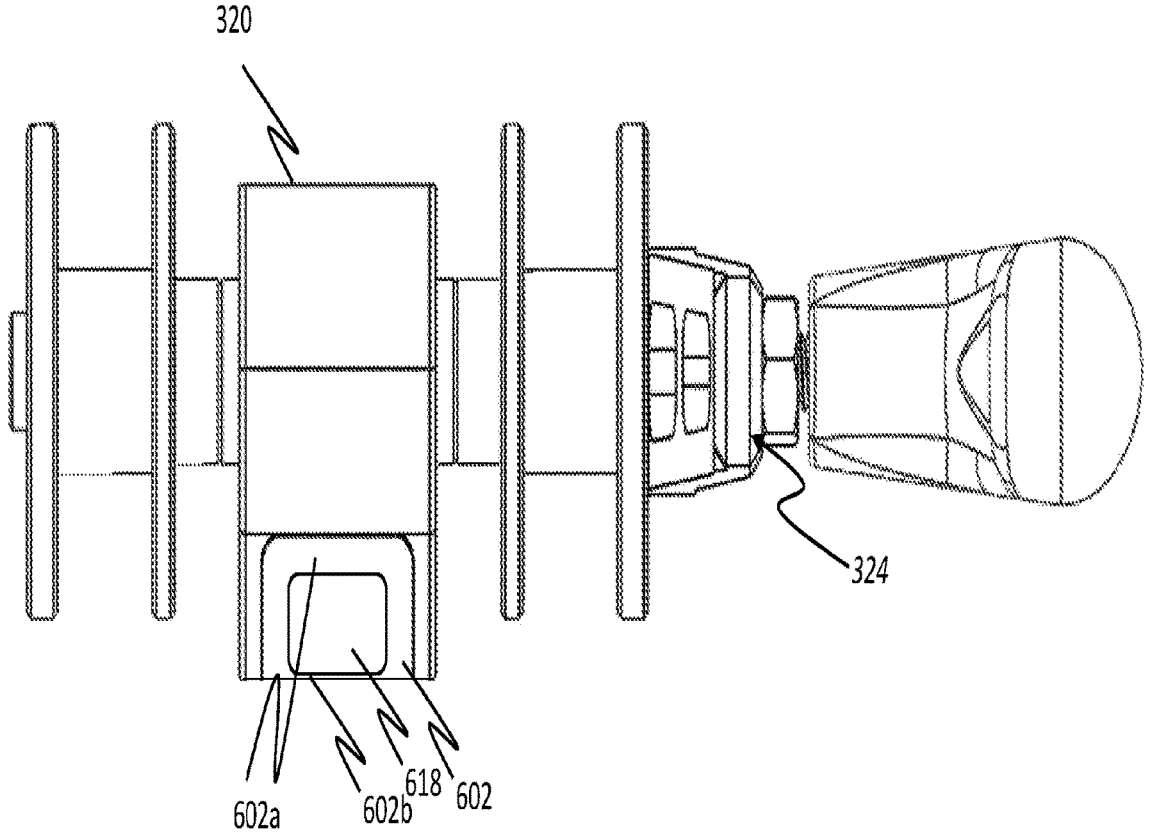

FIG. 33 shows a front view of a crank module and crank of the embodiment of FIG. 28.

DETAILED DESCRIPTION OF THE INVENTION

FIGS. 6-12 illustrate a first embodiment of a bowstring positioning system 300 for use with a crossbow 100. FIG. 6 is a right side partial cut away view of a crossbow and as is shown in FIG. 6, bowstring positioning system 300 has a mounting module 310, a rope cranking module 320, a rope 330 and a bowstring engagement system 340.

In FIG. 6, mounting module 310 is mounted to buffer tube 130 of crossbow 100, between stock 120 and frame 118 and rope cranking module 320 is joined thereto. As can be seen from FIG. 6, this positions rope 330 and bowstring engagement system 340 in a position that is substantially closer to bowstring 210 than is possible by mounting to a butt or stock. Additionally, this arrangement requires that rope 330 extend for a relatively short distance compared to the rope lengths required by butt mounted or butt integrated designs. This reduces the risks of entanglement of rope 330 with other features of crossbow 100 and with objects in the environment surrounding crossbow 100 and crossbow bowstring positioning system 300. Additionally, with rope 330 being relatively shorter forces not aligned with a direction of force applied by bowstring 210 will have less leverage in acting on rope cranking module 320.

Rope 330 can comprise, a conventional rope such as a wound assembly of fibers including plant based fibers, polymers, or other such assembled fibrous materials, chains of any type, polymeric strips, wires, or any other fabricated or assembled flexible and generally linearly extending material or combination of materials that can be used to perform the functions described herein.

FIG. 7 shows a bottom view of rope cranking module 320, while FIG. 8 shows a side view of rope cranking module 320 and FIG. 9 shows a front section view of rope cranking module 320 taken as illustrated in FIG. 8. As is shown in FIGS. 7-9, rope cranking module 320 has a housing 322, a crank 324 and an axle 326 about which a length of rope 330 can be wound. Optionally, rope cranking module 320 also has an axle lock 332 adapted to resist rotation of axle 326 and thereby prevent one or both of winding of rope 330 or unwinding of rope 330 about axle 326. Axle lock 332 can be controlled to allow rotation or to resist rotation by way of a user interface 334.

As is shown in FIGS. 6-9, a first connector 350 extends from, in this embodiment, a bottom surface 328 of housing 322. First connector 350 has a mounting post 356 supporting at least one lug extending away from the mounting post 356. In this embodiment, two such lugs are illustrated, lug 352 and lug 354. Lugs 352 and 354 extend from mounting post 356 at least in part along an axis is that is not parallel to an axis along which mounting post 356 extends. In this embodiment, lugs 352 and 354 are optionally illustrated as extending along a path that is generally parallel to a generally planar bottom surface 328 of housing 322 and are shown with upper surfaces separated from bottom surface 328 of housing 322 at least by a separation distance D1. Lugs 352 and 354 are also illustrated as having an equal lug height LH between an upper surface and a lower surface of lugs 352 and 354 of LH. This is optional and in embodiments using more than one lug, the heights of the different lugs may differ.

FIGS. 10 and 11 illustrate, respectively, a top view of mounting 310 and a cross-section of mounting 310 taken as is illustrated in FIG. 10. As is shown in FIGS. 10 and 11, mounting 310 has a surface 316 arranged to confront bottom surface 328 of rope cranking module 320 when assembled thereto. Mounting 310 has a second connector 360 designed for use with first connector 350. In this embodiment, second connector 360 has an interior chamber 362 with a first portion 364 extending from an opening 366 at surface 316 into buffer tube mounting 310. Opening 366 and interior chamber 362 are shaped and sized to receive mounting post 356.

In this embodiment, opening 366 and interior chamber 362 also includes lug passages 372 and 374 which are arranged, shaped, and sized to receive lug 352 and lug 354 of the embodiment of FIG. 6-8 when rope cranking module 320 is positioned within a first range of radial orientations relative to mounting 310. Where lugs of a mounting post are aligned with the lug passages 372 and 374.

As is shown in FIG. 11, first portion 364 of interior chamber 362 extends from surface 316 by a distance of D2 allowing first connector 350 to be inserted into second connector 360 and guiding first connector 350 to a second portion 380 of interior chamber 362.

Second portion 380 of interior chamber 362 has lug twist channels 382 and 384 shaped, sized and positioned to receive lug 352 and 354 after first connector (not shown in FIGS. 11 and 12) has been advanced by a predetermined distance into interior chamber 362 and a receiving portion 386 to receive mounting post 356. Optionally, a stop surface 388 can be provided to limit the extent to which first connector 350 can be inserted so as to align any lugs with lug twist channels 382 and 384 respectively. This can be done for example by positioning stop surface 188 to limit the extent to which mounting post 356 or one of lugs 352 and 354 can be inserted into interior chamber 362.

In this embodiment lug twist channels 382 and 384 are arranged to permit rotation of lug 352 and lug 354 so that buffer tube mounting 310 and rope cranking module 320 can be rotated from the first range of radial orientations to a second range of relative radial orientations. In the second range of relative radial orientations at least one of lug 352 and lug 354 cannot exit by way of lug passages 372 and 374 in response to forces that arise during rope positioning of bowstring 210 that might urge separation of buffer tube mounting 310 and rope cranking module 320. Such resistance can, for example, be provided by material forming and, optionally, mechanisms provided in second connector 360, which, in this embodiment comprise structures forming buffer tube mounting 310 between lug twist channels 382 and 384.

In the embodiment illustrated in FIGS. 10 and 11, first portion 364 extends by a distance D2 that is generally less than D1 and lug twist channels 382 and 384 have a channel height CH that is generally greater than the lug height LH of lugs 352 and 354.

As is also shown in FIG. 11, in this embodiment mounting 310 is shown as in a two-piece construction having a first mounting piece 312 and a second mounting piece 314, when combined for example, and without limitation, by fasteners 390 and 392 which extend in this embodiment through passageways 394 and 396. As is illustrated in FIGS. 10 and 11, first mounting piece 312 and second mounting piece 314 form a buffer tube receiving area 400 having a first part 402 shaped in a manner that can receive and mount about buffer tube 130 of crossbow 100 and a second part 404 that can receive and mount about at least a portion of ridge 132 of crossbow 100. In the example illustrated here, first mounting piece 312 has a buffer tube engagement surface 412 adapted to confront a first portion of buffer tube 130 while second mounting piece 314 has a buffer tube engagement surface 414 that is shaped and sized to confront a second portion of buffer tube 130. Similarly, first mounting piece 312 has a ridge confronting surface 422 that is shaped and sized at least a portion of ridge 132 while second mounting piece 314 has a ridge confronting surface 424 that is shaped to confront another portion of ridge 132. It will be understood that the use of a two-part construction is not limiting and mounting 310 can use a construction having more than two parts. Additionally, it will be appreciated that any form of fastener may be used to hold two or more parts of mounting about a buffer tube 130.

FIG. 12 illustrates mounting 310 assembled to a buffer tube 130 and ridge 132 and having rope cranking module 320 assembled thereto. This view is taken in section as is shown in FIG. 6.

As is illustrated in FIG. 12, buffer tube confronting surfaces 412 and 414 and optionally ridge confronting surfaces 422 and 424 are mounted to buffer tube 130 and ridge 132 such that the strength of buffer tube 130 and ridge 132 can be used to resist axial and longitudinal forces applied against mounting 310 by rope cranking module 320 when rope cranking module 320 is in use. Additionally, in this embodiment ridge confronting surfaces 422 and 424 are shaped and sized to cooperate with ridge 132 to resist any forces causing unwanted rotation of mounting 310 relative to buffer tube 130. It will be appreciated that a ridge 132 may have any of a variety of shapes and that ridge confronting surfaces may be used to confront any portions of ridge 132 for similar purposes.

FIGS. 13 and 14 are top views of bowstring positioning system 300 when gripping crossbow bowstring 210 in the initial range of string positions thereof and having moved bowstring 210 to a second range of positions. When it is necessary to reposition bowstring 210 into engagement with bowstring capture and release system 116 in anticipation of firing crossbow 100, bowstring engagement system 340 is pulled away from rope cranking module 320 until bowstring engagement surfaces 342 of bowstring engagement system 340 can be brought into engagement with bowstring 210. As this occurs, rope 330 is unspooled from axle 326.

After a user engages bowstring engagement surfaces 342 with bowstring 210, the user can begin to turn crank 324 to reduce the length of rope 330 between rope cranking module 320 and bowstring engagement system 340. Such turning of crank 324 brings bowstring 210 closer to bowstring capture and release system 116 and is continued until, as is illustrated in FIG. 14, bowstring 210 is positioned to be captured and held by bowstring capture and release system 116.

As noted above, crossbow 100 resists movement of bowstring toward bowstring capture and release system 116 and optional axle lock 332 can be used to prevent bowstring 210 from moving according to this bias in the event that crank 324 is inadvertently released or a user wishes to pause during the cranking process.

It will be appreciated that substantially less rope 330 must be stored in and extended from rope cranking module 320 than is necessary in circumstances where a cranking system is positioned in stock 120 or at butt 122 of crossbow 100. This reduces the likelihood that rope 330 will become entangled and lowers the amount of rope weight that a user must carry during cranking. This also reduces the amount of time that a user must expend in reeling in rope 330 after bowstring 210 is brought into engagement with bowstring engagement system 340. This may also have the effect of limiting the extent to which torque or forces in directions other than a direction of a bias exerted by limbs 172, 172, 174 and 176 though bowstring 210 may be created during loading as buffer tube 130 and in embodiments may allow rope 330 to be moved along a path that is generally more in line with the path of movement of bowstring 210.

FIG. 15 is a rear, left, top perspective view of another embodiment of mounting 310 and a rope cranking module 320 that may be used in embodiments of a bowstring positioning system 300. FIG. 16 is an assembly view of one embodiment of a first connector 350 and a second connector formed by first mounting piece 312, housing 322 and a plate 430. FIG. 17 is a top front right perspective view of bowstring positioning system 300 of FIG. 15 with components of rope cranking module 320 above a bottom surface 328 cut away. FIG. 18 is a partial cutaway center left facing cross section of the bowstring positioning system of FIG. 15. FIG. 19 is a partial cut away right side elevation view of bowstring positioning system 300 of FIG. 15.

As is shown in FIGS. 15-19 in this embodiment, mounting 310 is arranged with a first mounting piece 312 and a second mounting piece 314 that can be assembled around buffer tube 130 and ridge 132 along a different axis than the embodiment shown in FIGS. 6-13. In particular, in this embodiment, second mounting piece 314 is configured with internal surfaces that can engage a ridge (not shown) and a portion of a buffer tube (not shown) while first mounting piece 312 is provided with internal surfaces adapted to engage portions of buffer tube 130 that are not engaged by second mounting piece 314. Mounting 310 can be mounted to the buffer tube (not shown) and ridge (not shown) by assembling first mounting piece 312 and second mounting piece 314 using fasteners such as fastener 390. Additionally, in this embodiment, first connector 350 is provided on first mounting piece 312 of mounting 310 while second connector 360 is provided at rope cranking module 320.

In this embodiment, first connector 350 again comprises lugs 352 and 354 supported by a mounting post 356 while second connector 360 includes an interior chamber 362 with a first portion 364 having an opening 366 sized and shaped to receive mounting post 356 and lug passages 372 and 374 sized and shaped to receive lugs 352 and 354. Interior chamber 362 also has a second portion 380 having lug twist channels 382 and 384 and an optional stop surface 388 that generally operate as in the previous embodiment. However, as is shown in FIGS. 16 and 17, first portion 364 is defined as a channel 432 that passes through a plate 430 with second portion 380 defined in an area between a surface 434 of plate 430 and stop surface 388 provided by housing 322. Plate 430 is then fixed to bottom surface 328 of housing 322 by fasteners, welding or any other known technology for strongly joining a plate proximate to another surface.

Axle 326 has reel structures 438 to guide and manage rope 330 during winding and unwinding operations. Reel structures 438 may be located inside housing 322 or outside of housing 322 as illustrated in this embodiment. In embodiments, axle 326 may be joined to crank 324 at and end portion thereof and the end portions of axle 326 may be adapted so that crank 324 can be joined to either of the end portions of axle 326 to allow operation by either a left hand or a right hand of a user as desired by the user.

FIG. 18 additionally shows one embodiment of an axle lock 332. In this embodiment a rotation latch 446 is fixedly joined to axle 326 and a pawl is positioned to be interposed in the path of 446. Pawl 448 is biased by a spring 444 or other biasing member against rotation latch 446. Rotation latch 446 is designed to pass pawl 448 when rotated in a first direction but not when rotated in the opposite direction. A user interface 334 can be triggered to release rotation latch 446 for rotation in the opposite direction where required.

FIG. 20 is a front elevation view of another embodiment of a mounting 310 and a rope cranking module 320 that may be used in embodiments of a bowstring positioning system 300. FIG. 21 is a side cross-section view of the embodiment of FIG. 20 taken as illustrated in FIG. 20 and in partial cut away. FIG. 22 shows the embodiment of FIG. 20 in a front, right side top perspective view with a spool removed. In the embodiment of FIG. 20, first connector 350 comprises a post 440.

In this embodiment, first connector 350 and second connector 360 make use of a post/hole arrangement to enable rapid and secure mounting and dismounting of rope cranking module 320 to mounting 310. Here, rope cranking module 320 has a first connector 350 with a post positioning chamber 460 that is on the interior of first connector 350 in a space defined by walls 462, 464, 466, 468 and 470. Walls 462, 464, 466, 468, and 470 are configured to provide a post opening 472.

Mounting 310 has a second connector 360 with a mounting post 452 sized and shaped for engagement with a post positioning chamber 460. A support 454 connects mounting post 452 to mounting 310. In the embodiment of FIGS. 20-23 a second connector 360 is shown with a wall 456 that is positioned proximate to and shaped to engage wall 464 on a side opposite from post positioning chamber 460 when mounting post 452 is positioned to engage post positioning chamber 460.

Post positioning chamber 460 and post opening 472 are shaped and sized to receive mounting post 452. In the embodiment of FIGS. 20-23, walls 462, 464, 466 and 468 are illustrated here as being generally shaped and oriented to conform to a shape and orientation of confronting portions of mounting post 452 and mounting post 452 is illustrated as being sized and shaped to fit into post positioning chamber 460 with limited tolerances when assembled to post positioning chamber 460.

In this embodiment, a length L1 of mounting post 452 between an outer surface 480 of mounting post 452 and an inner surface 482 of mounting post 452 optionally generally equal to a length L2 between wall 462 of mounting post 452 and outer surfaces 486, 488 and 490 of walls 466, 468 and 490 respectively. In a conventional rail system an approach length of twice length L1 or L2 would be required to assemble first connector 350 to second connector 360. Here this is not necessary as, this embodiment post opening 472 is further defined by a wall 464 having a surface 494 that is separated from surfaces 486, 488 and 490 by a length L3. In the embodiment illustrated L3 is about half of L1 and L2. Accordingly, in this embodiment the approach length required to assemble first connector 350 and second connector 360 is about 1.5 times L1 and L2. Additionally, in embodiments, wall 464 can be shaped and any of walls 462, 466, mounting post 452, support 454 and optional wall 456 can be shaped to permit at least some degree of pivot or rotational motion about surface 494 of wall 464 during assembly of first connector 350 and second connector 360 which may have the effect of further reducing a required approach length.

FIG. 21 illustrates, generally, the forces acting on bowstring positioning system 300 when a force F1 is applied against axle 326 during bowstring positioning. At least a portion of force F1 extends along a direction that is generally parallel with wall 464 and wall 466 and this force illustrated as force F3 urges wall 462 against inner surface 482 of mounting post 452. Additionally, in embodiments, a portion of force F1 may also urge surface 494 against support 454 in the form of a second force F2.

In embodiments, other walls such as wall 456 of second connector 360 may be drawn into contact with, for example, mounting post 452 and a portion of force F1 may be transferred as force F3 against, in this embodiment support 454 in a direction that is generally parallel with walls 464 and 466. In embodiments this direction may be a direction of bias force created by bowstring 210 during positioning.

As is shown in FIG. 20, post opening 472 is aligned relative to an anticipated direction of force F1 to be experienced by rope cranking module 320 during bowstring positioning operations such that forces F1 and F2 applied by a bowstring 210 against axle 326 and thence to first connector 350 draws first connector 350 and second connector 360 into tighter alignment.

As is also shown in FIG. 21, in this embodiment, axle 326 may be separated from post 440 along directions other than a direction of forces F2 and F3 when force F1 is applied at axle 326. Accordingly, forces may be experienced at first connector 350 and second connector 360 along directions other than the direction of force F For example, this arrangement may induce torque forces F4 and F5. It is necessary to provide structures that can withstand such forces. However it is desirable to do so in ways that do not require long engagement lengths and approaches as are required by slide mountable rail systems.

It will be appreciated that the use of a first connector 350 having post positioning chamber 460 and a second connector 360 having embodiments of mounting post 452 provides significantly more engagement area between mounting post 452 and walls 466 and 464 along directions other the direction of forces F2 and F3 than is possible from a rail system having a similar length and can therefore resist forces such as F4 and F5 to a greater extent per unit length than can such rail systems. For these reasons and for the reasons noted above, bowstring positioning system 300 can have a shorter length and be mounted to structures such as buffer tube 130 without requiring substantial approach lengths during mounting.

Additionally, the embodiment of FIGS. 20-22 can enable rapid installation and removal of rope cranking module 320 from mounting 310 while still providing secure mounting during use. Further, in embodiments, walls 460-468 and mounting post 452 may be defined in a manner that provides enhanced alignment between an along which mounting 310 is joined and an axis along which rope cranking module 320 is positioned.

FIG. 23 shows a front elevation view of still another embodiment of a mounting 310 and rope cranking module 320 useful in a bowstring positioning system 300, while FIG. 24 shows the embodiment of FIG. 23 in partial cross-section, FIG. 25 shows the embodiment of FIG. 23 assembled and in a right, front top perspective with a spool removed, FIG. 26 shows the embodiment of FIG. 23 in a right side elevation with a portion of housing 322 cut away and a spool removed, and with a rope and bowstring engagement system omitted.

In this embodiment, a quick release clamping system 500 is used to hold first connector 350 and second connector 360 together. As is shown in FIG. 24, in this embodiment first connector 350 has a lug 352 separated from a surface 316 of mounting 310 by a mounting post 356. Second connector 360 has an interior chamber 362 with quick release clamping system 500. In the embodiment illustrated, quick release clamping system 500 includes a slide latch 510 that is slideably mounted to housing 322 between a first position allowing first connector 350 to exit interior chamber 362 and a second position preventing separation of first connector 350 and second connector 360.

FIGS. 23-26 illustrate slide latch 510 in the second position. Here this takes the form of positioning a slide latch 510 within in interior chamber 362 proximate to mounting post 356 and between lug 352 and an opening 366 leading to interior chamber 362. This blocks lug 352 from exiting from interior chamber 362.

In the embodiment of FIGS. 23-26, slide latch 510 is moved between the first position and the second position by a handle 520. Handle 520 is joined to slide latch 510 using a slot 512 by a slide pivot 514 and handle 520 is also pivotally joined to pivot mount 530 by a handle pivot 532 and is pivotally movable about handle pivot 532 to induce motion of slide latch 510 between the first and the second position. A biasing member 540 is positioned between handle 520 and housing 322 and to bias handle such that handle 520 biases slide latch 510 into a position that prevents separation of first connector 350 from second connector 360. To mount rope cranking module 320 to mounting 310, handle 520 can be moved against the bias to move slide latch 510 such that first connector 350 can be inserted into interior chamber 362. Subsequent release of handle 520 allows slide latch 510 to move in response to the bias back into the second position to hold first connector 350 in interior chamber 362.

It will be appreciated that this embodiment allows the advantages of quick connection and quick disconnection and without requiring an approach path of the length required by rail systems. This system also provides a manual control that is biased into a capture position.

FIG. 27 shows a right side elevation view of another embodiment of a mounting 310 and rope cranking module 320 useful in a crossbow bowstring positioning system 300. Here, slide latch 510 is shaped such that slide latch 510 will interact with lug 352 during insertion of first connector 350 into opening 366 such that a portion of the force used to insert slide latch 510 into opening 366 will overcome the bias supplied by biasing member 540 to slide latch 510 into a position that allows lug 352 to pass into interior chamber 362. After lug 352 moves past slide latch 510, the force supplied by biasing member 540 drives slide latch 510 back into a position that blocks passage of lug 352 from opening 366 unless the user manipulates handle 520 in a manner that causes such movement. In this embodiment, this effect is achieved by providing a sloped surface 516 on an outwardly facing side of slide latch 510. It will be appreciated that this allows for rapid connection of rope cranking module 320 to mount 310.

Here again, such a system can be used to reliably and quickly mount and dismount a rope cranking module 320 to a buffer tube 130 of a crossbow 100 without requiring clearance for an elongate approach and modification of crossbow components to accommodate such an approach.

It will be appreciated that the embodiments of the inventions disclosed herein are useful for crossbow cocking and may also be used for de-cocking purposes or for any other bowstring positioning purposes. Additionally, the embodiments herein may be used to mount devices other that crossbow cocking systems to crossbows to other objects or surfaces of a crossbow, of a firearm, paintball gun, or air gun wherein a strong mounting arrangement is necessary and a rail type engagement system is not practicable or advantageous. In such applications these embodiments may provide the advantages discussed herein as well as other advantages.

FIG. 28 is a front, left, top perspective cut away view of another embodiment of mounting 310 and a rope cranking module 320 that may be used in embodiments of a bowstring positioning system 300. In FIG. 28, rope cranking module 320 is shown without rope and with a portion of a crank 324 cut away. FIG. 29 is a partial cut-away left, front, top perspective and sectioned view of mounting 310 and rope cranking module 320 of FIG. 28. FIG. 30 is a front, left, top orthogonal view of mounting 310 and rope cranking module 320 assembled together and FIG. 31 is a front elevation view of mounting 310 and rope cranking module 320 assembled together.

In this embodiment, mounting 310 has a first mounting piece 312 and a second mounting piece 314 that can be assembled around, for example, a buffer tube 130 and a ridge 132 (shown for example in section in FIG. 31 and in partial cut away form in FIG. 32) In this embodiment, ridge confronting surfaces 422 and 424 are formed in second mounting piece 314 and are shaped and sized to confront surfaces of ridge 132 such that the strength of buffer tube 130 and ridge 132 can be used to resist axial and longitudinal forces applied against mounting 310 by rope cranking module 320 when rope cranking module 320 is in use. Additionally, in this embodiment ridge confronting surfaces 422 and 424 are shaped and sized to cooperate with ridge 132 to resist any forces causing unwanted rotation of mounting 310 relative to buffer tube 130. It will be appreciated that a ridge 132 may have any of a variety of shapes and that ridge confronting surfaces may be used to confront any portions of ridge 132 for similar purposes in particular, in this embodiment, second mounting piece 314 is configured with internal surfaces that engage ridge 132 and a portion of buffer tube 130 while first mounting piece 312 is provided with internal surfaces adapted to engage portions of buffer tube 130 that are not engaged by second mounting piece 314. Mounting 310 can be mounted to a buffer tube 130 and ridge 132 by assembling first mounting piece 312 and second mounting piece 314 using fasteners such as fastener 390. Additionally, in this embodiment, first connector 350 is provided on first mounting piece 312 of mounting 310 while second connector 360 is provided at rope cranking module 320.

Rope cranking module 320 is shown having a first connector 350 with a crank post 600 extending from a front facing crank wall 602 and having a plurality of crank post reference surfaces 610, 612, 614 and 616 while mounting 310 has a second connector 360 with a hole 630 that is defined generally by a plurality of mounting sidewalls shown here as mounting sidewalls 640, 642, 644 and 646. Mounting sidewalls 640, 642, 644 and 646 may be integrally formed with, may share a substrate material, may be fixed, joined, assembled or otherwise mechanically associated with mounting 310 for movement therewith.

In the embodiment of FIGS. 28-33, mounting side walls 640, 642, 644 and 646 are illustrated as being generally shaped and oriented to conform to a shape and orientation of confronting crank post reference surfaces 610, 612, 614, and 616 of crank post 600 and as being sized and shaped to allow crank post 600 to enter crank post receiving area 630 and to engage mounting sidewalls 640, 642, 644 and 646 respectively so as to prevent, for example and without limitation, substantial movement of crank post 600 relative to side walls 640, 642, 644 and 646. As side walls 640, 642, 644 and 646 are mechanically associated with mounting 310 for movement therewith and mounting 310 is joined to buffer tube 130 and ridge 132, crank post 600 is held in a generally fixed position relative to buffer tube 130. This in turn holds rope cranking module 320 relative to buffer tube 130 during cranking operations.

Crank post 600 engages crank post receiving area 630 side walls 640, 642, 644, and 646 over an engagement distance when assembled thereto. In the embodiment that is illustrated, crank post 600 has a crank post length CPL of crank post 600 between an front face 618 of crank post 600 and a front facing crank surface 602 of cranking module 320 that is less than a mounting length ML between a rear face 670 and a front face 672 of sidewalls 610, 612, 614, and 616. In one non-limiting example, crank post length CPL can be ½ of the mounting length ML, such that the linear space required to assemble crank module 320 to mounting 310 is 1.5 times the mounting length ML.

By providing a crank post 600 with a crank post length CPL that is smaller than a mounting length ML, an approach length required to assemble crank post 600 to crank post receiving area 630 can be smaller than an approach length that would be required to assemble a crank module 320 having a crank post 600 with a longer crank post length CPL to an equivalent mounting 310. This can be important, when mounting to a buffer tube 130 as such a mounting 310 is often located within along lengths of a crossbow 100 where there can be limitations on the length available for such linear assembly such as may be caused by the location of a stock or other crossbow components that may occupy linear space adjacent to the buffer tube 130. Further, a smaller approach length allows more rapid assembly and disassembly of rope cranking module 320 and mounting 310.

When engaged, a force applied by a bowstring (not shown) against a bowstring engagement system (not shown) is transferred to axle 326 as a force F1 which is then transferred through first connector 350 and second connector 360 and into buffer tube 130.

One portion of force F1 acts generally along an axis that is generally parallel to a longitudinal axis of buffer tube 130. As mounting 310 is fixedly mounted to a buffer tube 130, rope cranking module 320 is driven against mounting 310 such that force F2 is applied by an upper portion of front facing crank wall 602*a* against an upper portion 670*a* of mounting back face 670 and such that a force F3 is applied by lower portion 602*b* of front facing crank wall 602 against a lower portion 670*b* of mounting back face 670. This urges crank post 600 to remain engaged with and crank post receiver 630.

Another portion of force F1 acts against axle 326 along an axis that is not parallel to the longitudinal axis. Accordingly, forces may be experienced at first connector 350 and second connector 360 along one or more directions that are not parallel to the longitudinal axis of the buffer tube (not shown.) For example, such forces may include torque forces F4 and F5. It is necessary to provide structures that can withstand such non-parallel forces and it will be understood that it may be challenging to do so in circumstances where the engagement length between crank post 600 and crank post receiving area 630 is limited.

However, in the embodiment that is illustrated in FIGS. 29-31, this challenge is addressed in part by defining a crank housing surface 608 to directly engage mounting 310 so that at least some of the force creating of torque forces F4 and f5 is transmitted directly from crank housing surface 608 into mounting 310. This reduces the overall that must be resisted at the engagement between crank post 600 and crank post receiving area in these other directions.

In the embodiment of FIGS. 28-33, portions of the mounting length ML of side walls 640, 642 and 644 crank post receiving area 630 that are further from rear face 670 than the crank post length CPL and that therefore do not engage crank post 630 can be used to provide a path between surface 608 of rope cranking module 320 and buffer tube 130 through which forces that are not generally parallel to a longitudinal axis of the buffer tube can be resisted by mounting 310 and buffer tube 130 without the use of post 630. This relieves the load that must be transmitted through the limited engagement between post 600 and post receiving area 630, in that a first portion of a force exerted by a bowstring can be resisted through the engagement between the post 600 and the first portion of the length of sidewalls 640, 642, 644 and 66 about the post receiving area 630 and wherein a second portion of the force can be resisted through contact between the housing and the second portion of the length of at least one sidewalls 640, 642, 644 and 646 or other portions of mounting 350.

Additionally it will be noted that crank module 320 and mounting 310 are configured for assembly at a first distance from the mounting tube over an engagement length. That is, for example, engagement between post 600 and post receiving area 630 can be configured as shown in FIGS. 28-33 for engagement along an a horizontal axis that is generally parallel to but separated from a horizontal axis of a buffer tube by a first distance along a vertical axis, while engagement between side wall 642 is shown adjacent to a surface of housing 322 of rope cranking module 320 at a second distance along the vertical axis from the buffer tube that is greater than the first distance. Additionally, rope cranking module 320 and mounting 310 are configured allow contact between the housing and the mounting apart from the engagement length. In this way an amount of length required to assemble the rope cranking module 320 and the mounting can be reduced to allow quick and easy assembly in the horizontal space provided between the stock and frame of the crossbow without compromising the amount of force that can be resisted by the combined crossbow rope cranking module 320 and mounting 310 when joined to the buffer tube of a crossbow. This can be accomplished by resisting a first portion of the force applied by a crossbow bowstring against the bowstring connector during positioning of the bowstring connector and bowstring through the engagement length at a first distance from the buffer tube and by resisting a second portion of the force through the contact between for example housing 322 and wall 642 occurring at a second distance from the buffer tube.

In examples, buffer tube 130 has been described at times as incorporating a ridge 132 which provides features that engage features of mounting 310 to resist rotation about an axis of buffer tube 130, it will be appreciated that structures or features other than ridge 132 may be used for similar purpose and that other structures or features that can be generally fixedly associated with buffer tube 130 and can engage with mounting 310 to resist forces urging mounting 310 to rotate about an axis of buffer tube 130. Such structures or features may include but are not limited to slots, keyways, channels, roughened surfaces, high friction surfaces and adhesive treated surfaces. In embodiments where such other features are provided on buffer tube 130, mounting 310 may have surfaces that are defined to interface with such features to prevent rotation of mounting 310 relative to a buffer tube having such surfaces or features. Additionally or alternatively in such embodiments, additional components including but not limited to such as fasteners, pins, adhesive activators may be used to mechanically link mounting 310 to buffer tube 130 to substantially prevent rotation of mounting 310 relative to buffer tube 130. Further, it will be appreciated that buffer tube 130 can comprise any structure connecting a frame 118 to a stock of a crossbow and need not be tubular in configuration.

Although the invention has been described in connection with a preferred embodiment, it should be understood that various modifications, additions and alterations may be made to the invention by one skilled in the art without departing from the spirit and scope of the invention.

What is claimed is:

1. A crossbow bowstring positioning system comprising:

a length of rope connected between two separated points on an axle supported by a housing;

a bowstring connector joined to the length of rope and connectable to a bowstring;

a mounting configured to couple to a crossbow, the mounting comprising a receiving area configured to engage a first surface of the housing and defined by an opening of the mounting, the opening including an inner surface and an outer surface, the mounting further comprising a first mounting piece and a second mounting piece, the first mounting piece and the second mounting piece configured to surround a portion of the crossbow when coupled together; and a crank operable to rotate the axle to control an extent to which the length of rope is wound onto the axle and a position of the bowstring connector relative to the axle;

wherein assembly of the housing and the mounting facilitates contact between the housing and the mounting, the contact comprising:

a first contact between the first surface of the housing and the mounting at an engagement length along at least a portion of the inner surface of the opening; and a second contact between a second surface of the housing and the mounting at the outer surface of the opening;

wherein a first portion of a force applied by the bowstring against the bowstring connector during positioning of the bowstring connector is resisted through the engagement length along at least the portion of the inner surface of the opening and a second portion of the force is resisted through the contact between the second surface of the housing and the mounting at the outer surface of the opening.

2. The crossbow bowstring positioning system of claim 1, wherein the housing includes a post and the mounting includes the opening arranged to receive the post over the engagement length.

3. The crossbow bowstring positioning system of claim 2, wherein:

the opening has a length;

the engagement length is less than the length of the opening.

4. The crossbow bowstring positioning system of claim 3, wherein the post extends from a front surface of the housing and the receiving area extends from a back-facing surface of the mounting toward a front-facing surface of the mounting.

5. A crossbow bowstring positioning system comprising:

a length of rope controllably windable form two separated points on an axle as the axle is rotated;

a bowstring connector joined to the length of rope and connectable to a bowstring;

a mounting including a first mounting piece and a second mounting piece, the first mounting piece and the second mounting piece configured to define a mounting aperture when coupled together, wherein the mounting is configured to couple to a crossbow via the mounting aperture;

a housing comprising a crank and the axle, the crank operable to rotate the axle to control an extent to which the length of rope is wound onto the axle and a distance between the axle and the bowstring connector connected to the bowstring, the housing including a first connector at a front facing surface of the housing configured to engage a second connector at a back facing surface of the mounting;

wherein, with the mounting coupled to the crossbow via the mounting aperture and the bowstring connector connected to the bowstring, the first connector is engaged with the second connector and an operation of the crank is configured to transmit a force exerted by the bowstring to the mounting, wherein at least one of the first connector or the second connector is a connector that includes a post and the other of the first connector or the second connector is a connector that includes an opening configured to receive the post to engage the post along a first portion of a length of the opening, the opening including an inner surface and an outer surface, wherein the connector that includes the post is further configured to contact the outer surface of the opening of the connector that includes the opening, wherein a first portion of the force exerted by the bowstring is resisted through engagement between the post and the first portion of the length of the opening, and wherein a second portion of the force exerted by the bowstring is resisted through the contact between the connector that includes the post and the outer surface of the opening of the connector that includes the opening.

6. The crossbow bowstring positioning system of claim 5, wherein the mounting includes the opening arranged to receive the post over an engagement length.

7. The crossbow bowstring positioning system of claim 6, wherein:

the engagement length is less than the length of the opening.

8. The crossbow bowstring positioning system of claim 7, wherein the post extends from a front-facing surface of the housing and the opening extends from a back-facing surface of the mounting toward a front-facing surface of the mounting.

* * * * *